US010767271B2

(12) United States Patent
Gordon et al.

(10) Patent No.: US 10,767,271 B2
(45) Date of Patent: Sep. 8, 2020

(54) ELECTROLYSIS REACTOR SYSTEM

(71) Applicants: Frank Edward Gordon, San Diego, CA (US); Harper John Whitehouse, San Diego, CA (US)

(72) Inventors: Frank Edward Gordon, San Diego, CA (US); Harper John Whitehouse, San Diego, CA (US); Stanislaw Szpak, San Diego, CA (US)

(73) Assignee: Inovi, Inc., San Diego, CA (US)

( * ) Notice: Subject to any disclaimer, the term of this patent is extended or adjusted under 35 U.S.C. 154(b) by 847 days.

(21) Appl. No.: 14/630,286

(22) Filed: Feb. 24, 2015

(65) Prior Publication Data

US 2016/0244889 A1 Aug. 25, 2016

(51) Int. Cl.

| | |
|---|---|
| ***C25B 15/02*** | (2006.01) |
| ***C25B 1/02*** | (2006.01) |
| ***C25B 11/04*** | (2006.01) |
| ***C25B 15/08*** | (2006.01) |

(52) U.S. Cl.

CPC ..... *C25B 15/02* (2013.01); *C25B 1/02* (2013.01); *C25B 11/04* (2013.01); *C25B 15/08* (2013.01)

(58) Field of Classification Search

CPC ..... C25B 15/02; C25B 1/02; C25B 11/04; C25B 15/08

See application file for complete search history.

(56) References Cited

U.S. PATENT DOCUMENTS

| | | | | |
|---|---|---|---|---|
| 6,991,719 | B2 | 1/2006 | Ovshinsky et al. | |
| 8,231,774 | B2 * | 7/2012 | Atreya | C25B 1/04 205/637 |
| 8,394,543 | B2 * | 3/2013 | Suyama | C04B 35/573 204/194 |
| 9,328,426 | B2 * | 5/2016 | Oppenheim | F22B 1/006 |
| 9,343,771 | B2 * | 5/2016 | Ise | F17C 11/005 |
| 9,500,318 | B2 * | 11/2016 | Gillia | C01B 3/0026 |
| 9,644,277 | B2 * | 5/2017 | MacKinnon | H01M 8/0267 |
| 9,878,277 | B2 * | 1/2018 | Chaise | C01B 3/0005 |
| 9,878,907 | B2 * | 1/2018 | Vyas | C01B 3/08 |
| 2005/0150164 | A1 | 7/2005 | Wootan et al. | |
| 2008/0296172 | A1 | 12/2008 | Davidson | |
| 2009/0152106 | A1 | 6/2009 | Yamauchi et al. | |
| 2009/0224546 | A1 | 9/2009 | Davidson | |
| 2009/0301407 | A1 * | 12/2009 | Cerny | F02D 19/081 123/3 |

(Continued)

FOREIGN PATENT DOCUMENTS

WO WO2012084738 A3 9/2012

OTHER PUBLICATIONS

International search report and written opinion (WO2015/130820A1); Cho, Han Sol (7 pages) dated Aug. 28, 2016.*

Pinkerton, BF; Wicke, B; "Bottling the Hydrogen Genie" The International Physicists, Feb./Mar. 2004, pp. 20-23.

(Continued)

*Primary Examiner* — Kevin R Kruer

(74) *Attorney, Agent, or Firm* — Morland C. Fischer

(57) ABSTRACT

This application relates to the production, storage, and controlled release of hydrogen for use in the hydrogen economy. More specifically, it relates to a novel electrolysis system design that utilizes electrolysis of ionized vapors and gasses to produce and store hydrogen in a hydrogen host material and the capability to reverse the electrolysis potential to provide safe, controlled hydrogen release.

13 Claims, 31 Drawing Sheets

(56) References Cited

U.S. PATENT DOCUMENTS

| | | | | |
|---|---|---|---|---|
| 2010/0101942 | A1* | 4/2010 | Pless | C01B 3/501 204/269 |
| 2010/0155233 | A1* | 6/2010 | Hwang | C25B 15/00 204/228.6 |
| 2010/0221624 | A1* | 9/2010 | Makino | H01M 8/04302 429/429 |
| 2010/0266917 | A1* | 10/2010 | Kelley | H01M 8/04492 429/429 |
| 2011/0006544 | A1* | 1/2011 | Geurts | B63J 99/00 290/1 A |
| 2011/0042203 | A1* | 2/2011 | McAlister | F24S 20/20 204/238 |
| 2011/0210010 | A1 | 9/2011 | Irvine et al. | |
| 2011/0300462 | A1* | 12/2011 | Baird | B60L 50/40 429/429 |
| 2012/0156581 | A1* | 6/2012 | Song | H01M 8/04604 429/432 |
| 2014/0106248 | A1* | 4/2014 | Luo | H01M 8/04335 429/420 |
| 2015/0236364 | A1* | 8/2015 | Noda | H01M 8/0656 429/418 |
| 2015/0340715 | A1* | 11/2015 | Chang | H01M 8/04074 429/414 |
| 2017/0077528 | A1* | 3/2017 | Bahar | H01M 8/04059 |
| 2018/0258767 | A1* | 9/2018 | Haberman | B60L 58/30 |
| 2019/0316735 | A1* | 10/2019 | Zilberman | H01M 8/04208 |

OTHER PUBLICATIONS

Wimmer, W; et al. "Temperature-dependent diffusion coefficients from ab initio computations: Hydrogen, deuterium, and tritium in nickel" Phys Rev B 77 134305 (2008).

"Diffusion of Hydrogen in Nickel" Materials Design (2009).

Dornheim, M; "Thermodynamics of Metal Hydrides: Tailoring Reaction Enthalpies of Hydrogen Storage Materials" Thermodynamics—Interaction Studies—Solids, Liquids, and Gases edited by Juan Carlos Moreno-Pirajan (2011) ISBN 978-953-307-563-1 pp. 891-918.

Braimam and Goldhirsch; "Taming Chaotic Dynamics with Weak Periodic Pertubations" Phys Rev Letters V 66, No. 20, May 1991, pp. 2545-2548.

Pyragas, "Continuous Control of Chaos by Self-controlling feedback" Phys Letters A 170 (1992) pp. 421-428.

Pyragas, "Delayed Feedback Control of Chaos" Phil. Trans R soc A(2006) V364, pp. 2309-2334.

Wimmer, e. al, "Temperature-dependent diffusion coefficients from ab initio computations: Hydrogen in nickel" http://http://www.osti.gov/scitech/serviets/purl/881301 Mar. 16, 2006.

"Hydrogen Storage, Metal Hydrides" http://www1.eere.energy.gov/hydrogenandfuelcells/storage/metal_hydrides.html.

Lee, SK et.al. "Hydrogen Permeability, Diusivity, and Soubility o SUS 316L Stainless Steele in the Temperature Range of 400 to 800C for Fusion Reactor Applications" Journal of the Korean Physical Society, vol. 59, No. 5, Nov. (2011) pp. 3019-3023.

* cited by examiner

ELECTROLYSIS REACTOR SYSTEM

The present application claims the benefit of Provisional Patent Application No. 61/946,263 filed Feb. 28, 2014, which is hereby incorporated by reference in its entirety.

BACKGROUND OF THE INVENTION

The worldwide demand for energy is growing. The US Energy Information Administration reported that in 2006, the world energy consumption was 500 exojoules=$500\times10^{18}$ J. In order for all people in the world to be brought up to the standard of living of the industrialized countries, worldwide production of energy would need to increase by a factor of four. In 2006, energy was approximately 10% of the total world gross domestic product. The cost of energy is a significant fraction of the GNP of developed countries and the lack of energy is a major obstacle to improving the standard of living for people in underdeveloped countries.

Currently, approximately 86% of the world's energy comes from fossil fuels, coal, oil, and natural gas. Even if there was an unlimited supply, the combustion of fossil fuels produces unacceptable levels of greenhouse gasses for example carbon dioxide. New forms of combustible fuels such as fuel from algae will also produce greenhouse gasses and biofuels such as ethanol have the added disadvantage that a source of food is being converted into fuel. One promising new technology uses hydrogen to produce "green" energy without producing greenhouse gasses. Several technological hurdles including improved methods to produce and store hydrogen must be overcome before the hydrogen economy becomes a reality.

One promising method to more efficiently produce hydrogen involves steam electrolysis. Current steam electrolysis systems utilize steam produced by nuclear reactors to produce hydrogen more efficiently than conventional liquid electrolysis methods. Numerous scholarly articles and several patent applications including US 2011/0210010 A1 Pub. Date: Sep. 1, 2011 and WO2012084738 A3, Sep. 13, 2012, herein incorporated by reference, describe steam electrolysis systems for the production of hydrogen.

Current methods of storing hydrogen includes the use of pressure vessels for containing both liquid hydrogen as well as compressed hydrogen gas but this approach presents unacceptable safety hazards for many applications. In addition, cryogenic flasks for storing liquid hydrogen can be very expensive to build and maintain. Another hydrogen storage approach is to store hydrogen in the lattice of metal hydride materials but several technical challenges need to be solved to make this technique practical. Goals for a metal hydride storage system include the ability to extract the hydrogen at the rate of 1.5 gram per second with the metal hydride temperature less than 80 degrees C. A less than five-minute refueling time has also been established which presents a challenge to dissipate the heat that would be produced when the hydrogen is loaded into the metal lattice. See. B: F. Pinkerton and B. Wicke, "Bottling the Hydrogen genie" *American Institute of Physics,—The Industrial Physicist*, February/March 2004 pp 20-23.

It is well established that loading hydrogen into nickel is an exothermic reaction and that the diffusivity of hydrogen into nickel or other metal lattices increases with temperature as seen in FIG. 17 Wimmer, W. Wolf, J. Sticht, P. Saxe, C. B. Geller, R. Najafabadi, and G. A. Young, "Temperature-dependent diffusion coefficients from ab initio computations: Hydrogen, deuterium, and tritium in nickel", *Phys. Rev. B* 77, 134305 (2008) herein incorporated by reference, which shows the temperature-dependent diffusion coefficients of hydrogen and its isotopes in nickel. As shown in Wimmer et al, increasing the nickel temperature from room temperature to 500° C. increases the diffusivity by 4 to 5 orders of magnitude. As shown in FIG. 17, increased temperature increases hydrogen diffusivity but this alone does not provide sufficient controls over the rate of hydrogen loading or release. See also "Diffusion of Hydrogen in Nickel" *Materials Design* (2009) herein incorporated by reference. One of the major issues with complex metal hydride materials, due to the reaction enthalpies involved, is thermal management during refueling. Depending on the amount of hydrogen stored and refueling times required, megawatts to half a gigawatt of heat must be handled during recharging on-board vehicular systems with metal hydrides. The present invention addresses this problem by the incorporation of a thermal management system that can include provision for recovering the energy from the exothermic reaction of hydrogen being charged into nickel.

BRIEF DESCRIPTION OF THE FIGURES

FIG. 26 3-Terminal electromagnetic (EM) signal generator.

BRIEF SUMMARY OF THE INVENTION

Figure 1:
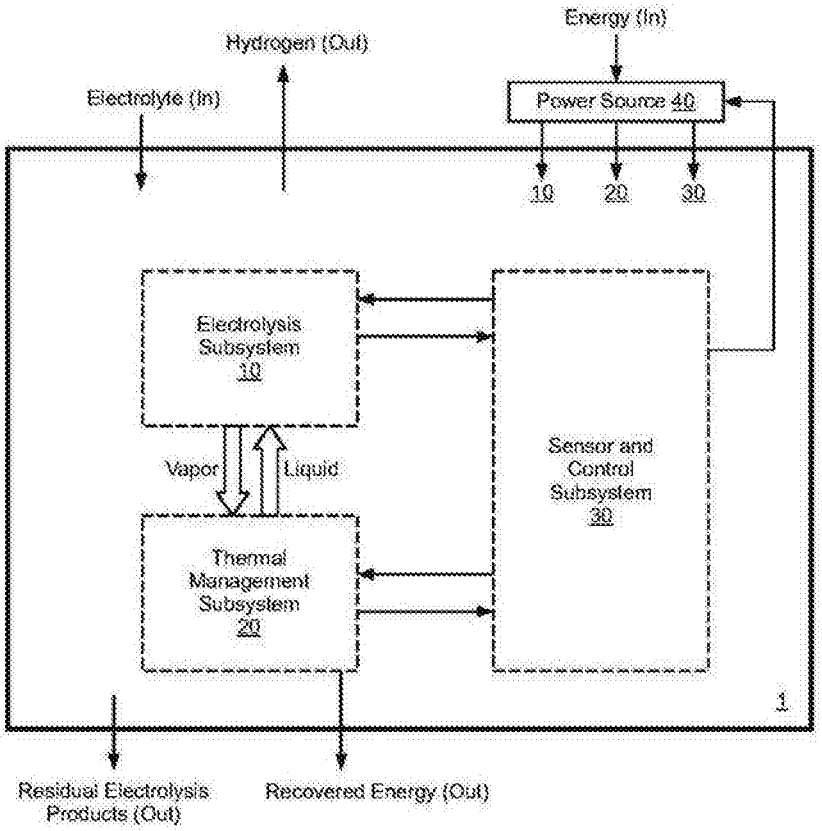
FIG. 1 shows a functional block diagram of the elements and relationships of an electrolysis reactor system for the production, safe storage, and release of hydrogen, comprised of an electrolysis subsystem 10, a thermal management subsystem 20, and a sensor and control subsystem with optional data recorder 30.

The present invention addresses the shortcomings of conventional approaches by incorporating novel designs that combine the improved efficiency of high-temperature electrolysis including the use of steam for example the electrolysis of the water vapor and metal ion containing electrolytes to more efficiently produce hydrogen, while also loading and storing the hydrogen at temperatures that take advantage of the increased diffusion rates of hydrogen in suitable materials for example, palladium, nickel, NiTiNOL, constantan, Ni/Al alloy, Pd/Ag alloy, $TiFeH_2$, and Pt. The invention also takes advantage of fugacity to load and unload the hydrogen contained in the working electrode which is used as the hydrogen storage medium. The invention's use of electrolysis also allows the controlled flow of hydrogen into and out of the working electrode by varying the current to control hydrogen flow into the working electrode and reversing the current to drive hydrogen out of the working electrode. The invention's use of electrolysis in a gas or vapor also allows control of the electrolytic reaction by varying the hydrogen ion concentration in the electrolyte. The use of steam or vapor electrolysis also allows the working electrode to be at high temperatures, which in nickel increases the diffusivity of hydrogen in the nickel. See "Thermodynamics of Metal Hydrides: Tailoring Reaction Enthalpies of Hydrogen Storage Materials" by Martin Dornheim, pp 891-918 contained in "Thermodynamics—Interaction Studies—Solids, Liquids and Gases" edited by Juan Carlos Moreno-Pirajan, (2011) ISBN 978-953-307-563-1, which is herein included by reference in its entirety. Throughout this invention, the mention of hydrogen includes hydrogen ions and the ions of hydrogen isotopes including deuterium and tritium. The electrolysis overpotential applies virtual pressure known as fugacity separately or in combination with increased pressures and temperatures, thereby increasing the loading rates of hydrogen into the storage material. Since increased loading rates can lead to exothermic reactions that increase nonlinearly as temperatures increase in the working electrode, this design incorporates a nonlinear control mechanism including utilizing the heat of vaporization of the cooling fluid to control the temperature in the working electrode. Long-term storage of hydrogen is maintained in the working electrode by reducing the temperature to reduce diffusivity, pressure, a physical diffusion barrier, and/or electrical overpotential. Controlled release of the hydrogen from the working electrode is achieved by heating the working electrode and by reducing and/or reversing the overpotential between the counter-electrode and the working electrode to drive out the hydrogen. Electrode designs can also incorporate at least one diffusion barrier to prevent undesired hydrogen release from the active electrode materials.

This invention includes but is not limited to:

1. The ability to load and maintain a high loading of hydrogen into suitable working electrode materials and/or composites, including the capability to control the flux of hydrogen into and/or out of the working electrode materials while operating within the pressure and temperature ranges that has been shown to support increased hydrogen diffusivity and permeability into and out of the working electrode materials.
2. The ability to apply additional stimuli that has been shown experimentally to be beneficial to loading the working electrode with hydrogen including static and dynamic magnetic fields and electric fields including sparks and plasmas, and ultrasonic stimulation to help initiate and control the hydrogen flux into and out of the working electrode materials.
3. The ability to conduct, transfer, and transport the heat produced in the working electrode away from the working electrode and to control the heat transfer rate to maintain the working electrode within the temperature range for sustained hydrogen flux rates while preventing the working electrode from overheating which can result in sintering, rupturing, or melting of the materials, and the ability to recover energy from the heat produced.
4. The ability to utilize a wide variety of materials that are capable of loading and storing hydrogen, including but not limited to bulk lattice materials, deposits of lattice materials, and aggregates of materials including micro- and nanoparticles in or on the working electrode.

5. The ability to utilize composite working electrode designs such as a hydrogen permeable membrane to contain hydride nano-particles materials.

6. The ability to utilize a plurality of control mechanisms to control the nonlinear behavior of the system including but not limited to control of chaos techniques to maintain production, loading, storage, and release while controlling the temperatures within the reactor subsystem. See for example: "Taming Chaotic Dynamics with Weak Periodic Perturbations" by Braimam and Goldhirsch, Phys Rev Letters V 66, Number 20, May 1991 pp 2545-2548, and "Continuous control of chaos by self-controlling feedback" by Pyragas, Physics Letters A, 170 (1992) 421-428, and "Delayed feedback control of chaos" by Pyragas, Phil. Trans. R. Soc. A(2006)364, 2309-2334 all herein incorporated by reference.

These capabilities are achieved through a system design that includes three subsystems including the electrolysis subsystem, a thermal management subsystem, and a sensor and control subsystem with data recording:

DETAILED DESCRIPTION OF THE INVENTION

Definitions

For purposes of this document, the following definitions apply:

Electrolysis: The passage of an electric current through an electrolyte with subsequent migration of positively and negatively charged ions to the negative and positive electrodes.

Electrolyte: A solid, liquid, mist, vapor, or gas containing charged ions that are mobile in the presence of an electric field. A mist is small droplets of liquid or particles that are dispersed in a gas. Examples of electrolytes include but are not limited to: A proton conductor in an electrolyte, typically a solid electrolyte, in which H-ions are the primary charge carriers. Electrolyte liquids and mists are normally formed when a salt is placed into a solvent such as water and the individual components dissociate due to the thermodynamic interactions between solvent and solute molecules, in a process called solvation. It is also possible for substances to react with water producing ions, e.g., carbon dioxide gas dissolves in water to produce a solution which contains hydronium, carbonate, and hydrogen carbonate ions. Note that molten salts can be electrolytes as well. For instance, when sodium chloride is molten, the liquid conducts electricity. Some gases, such as hydrogen chloride can contain ions and function as an electrolyte under the right conditions. The difference between a gas and a vapor: A gas is a single well-defined thermodynamic phase, whereas a vapor is a mixture of two phases (generally gas and liquid). Wet steam, typically at low temperature and pressure, is a combination of mist and vapor in which not all of the liquid has been vaporized. When all of the liquid has vaporized as temperature increases, dry steam (super heated steam) is produced. For this invention, the use of the term electrolyte can also include liquid, mist, vapor, steam, or gas that is ionized or further ionized in an ionizer or as the electrolyte is being ejected from an electrically charged injector or mister. For this invention, the use of the term electrolyte can also include hydrogen host material such as palladium ions and nickel ions that are deposited onto the working electrode and may be co-deposited at the same time as the hydrogen ions.

Working electrode: The working electrode is the electrode in an electrochemical system where the reaction of interest is occurring. The working electrode may be composites of materials where the reactants (hydrogen) are stored, modified, or consumed. The materials in the working electrode include hydrogen host materials and may include a low hydrogen permeable diffusion barrier. The working electrode can be either the anode or the cathode. The working electrode may include a composite working electrode that is composed of one or more materials, configured to provide a reaction volume where the reactants are stored, modified or consumed.

Hydrogen host materials: For this application, hydrogen host materials include any lattice materials into which hydrogen will diffuse including but are not limited to palladium, palladium alloys, nickel, nickel alloys, ceramics, and other materials or aggregates of materials such as but not limited to nanoparticles of nickel and zirconium oxide as well as nanoparticles of palladium and zirconium oxide.

Counter-electrode: The counter-electrode forms a pair with the working electrode to provide the electrical current and potential required for electrolysis.

Reference electrode: An electrode that does not participate directly in the electrolysis but can be used to measure and/or control the overpotential occurring at the working electrode during electrolysis. Although not shown in the figures, its use is the same as with electrolysis known to people working in the field.

Reactant: A substance participating in a reaction, especially a directly reacting substance present at the initiation of the reaction. See, San Diego State University, Chemistry 200/201/202 General Chemistry, McGraw-Hill, ISBN-13: 978-0-07-775963-6 2012. The substance may undergo a chemical change or be consumed or modified by the reaction. Substances initially present in a reaction that may be consumed during the reaction to make products.

Hydrogen: For purposes of this invention, references to hydrogen include hydrogen isotopes deuterium and tritium and their respective ions.

Loading and unloading: diffusing hydrogen ions into and out of the working electrode.

Hydrogen diffusion barrier: This includes materials such as copper and stainless steel that have a very low permeability to hydrogen and if necessary, can also include a thin layer of gold plating. Austenitic stainless steels, aluminum (including alloys), copper (including alloys), and titanium (including alloys) are generally applicable for most hydrogen service applications.

Injector: For purposes of this invention, an injector is a port, aperture, or fenestration where liquid, vapor or gas is passed from one location to another. For purposes of this invention, a "mister" can be considered an injector. The injector can also include a porous pipe made of either metal or ceramic materials. An injector may or may not be part of one of the electrodes and include the ability to ionize or further ionize the liquid, vapor, or gas being emitted from the injector.

Magnetic fields include static magnetic fields such as those generated by a permanent magnet and dynamic magnetic fields such as those generated by a time-varying current as well as electromagnetic fields such as radio frequency fields.

Fluidic contact includes the interactions between a fluid and a surface or component such as but not limited to the ability to provide for heat transfer and the ability to transfer liquid, vapor, or gas between components of the system for example of two components being in fluidic contact in that the two components are joined by a pipe.

Heat transfer plenum: For purposes of this invention the heat transfer plenum is a chamber into which thermal energy is transferred from the working electrode, thereby cooling or maintaining the temperature in the working electrode. The heat transfer plenum further acts to collect and remove the thermal energy. This can be accomplished by introducing a heat transfer medium such as water spray, mist, or vapor that is at or below the desired temperature control temperature into the chamber where the transfer medium is heated and conducted or flowed out of the plenum.

Plasma generator refers to a device such as a spark plug that generates an electromagnet pulse and/or a plasma that both generates ions and assists in the recombination of hydrogen and oxygen gas.

Hydrogen/oxygen separator/recombiner: A device to separate or recombine the oxygen and/or hydrogen from a vapor stream.

Vapor: For purposes of this invention, a vapor includes a fluid that may be a gas and/or a mixture of two phases such as a gas and a liquid that may contain small droplets or particles mixed with the gas and/or a mist that contains small droplets or particles.

Thermal contact: Is the ability to transfer heat between components including heat transfer by conduction, convection, and radiation.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

An embodiment of the present invention includes three primary subsystems: an electrolysis subsystem, a thermal management subsystem, and a sensor and control subsystem that includes a data recorder as shown in FIG. 1. It will be recognized that the functions of this system design can be implemented using many different working electrode materials, different electrolytes and different control protocols for the production, diffusion into, storage, and diffusion out of the working electrode of hydrogen. It will also be recognized that the features and functions of this system can be implemented in multiple physical designs and configurations.

FIG. 1 illustrates a functional block diagram of an Electrolysis Reactor System (1) for the production, storage, and release of hydrogen which is comprised of three subsystems: an electrolysis subsystem (10), a thermal management subsystem (20), and a sensor and control subsystem (30). The electrolysis reactor system receives electrical power from a power source (40) and hydrogen containing electrolyte from an external source. It outputs hydrogen which is available for use for example in a fuel cell, burned as fuel, and chemical processing as well as residual electrolysis products that may have been present in the electrolyte, and recovered energy.

Figure 2:
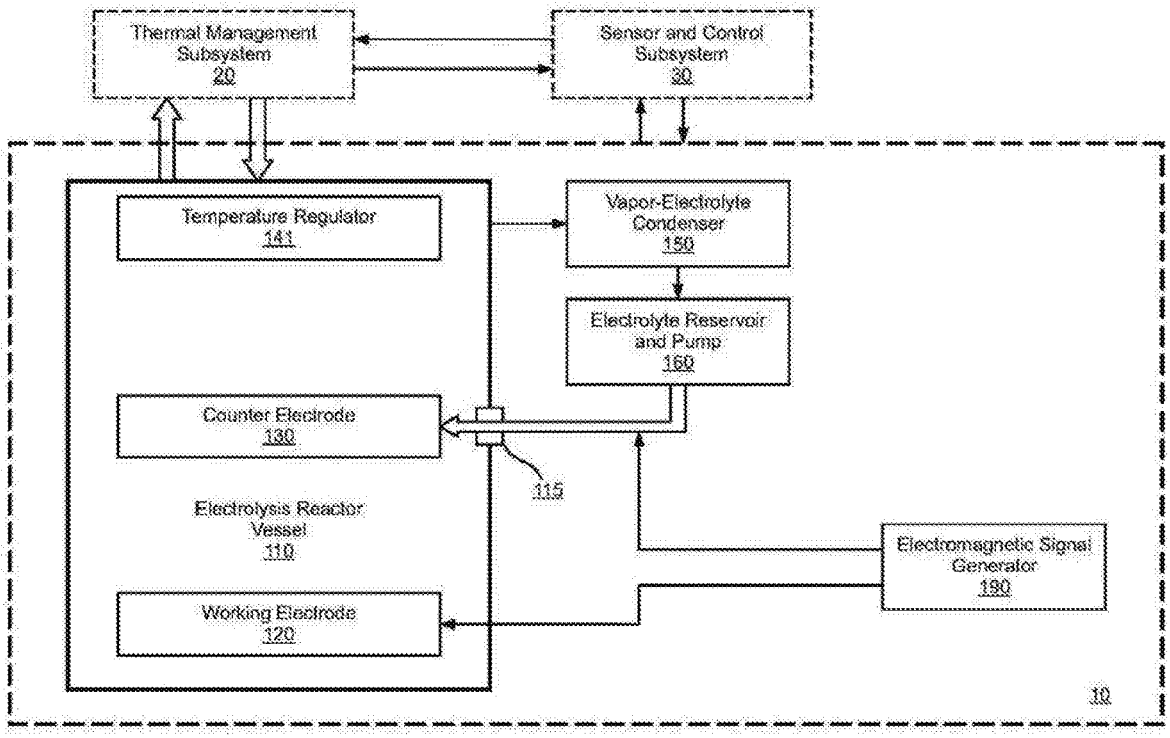
FIG. 2 shows a functional block diagram of the elements and relationships of an electrolysis subsystem 10.

FIG. 2 illustrates a functional block diagram of an electrolysis subsystem (10) which is comprised of an electrolysis reactor vessel (110), a working electrode (120), a counter-electrode (130), and a temperature regulator (141). Electrolyte containing hydrogen is supplied to the counter-electrode through an electrical insulated feed-thru (115) to maintain electrical isolation between the counter-electrode and the working electrode. The operational temperature in the reactor will cause the electrolyte to vaporize as the electrolysis occurs between the counter-electrode and the working electrode. The vaporized electrolyte is recovered through a vapor-electrolyte condenser (150) and an electrolyte reservoir and pump (160), an electromagnetic signal generator (190), as shown in FIG. 22, that provides stimulus to the working electrode to assist in the diffusion of hydrogen into and out of the working electrode. The thermal management subsystem (20) supplies cooling fluid to the reactor and receives high temperature vapor from the reactor. The sensor and control subsystem (30) including processor, for example a micro processor or computer and with optional data recorder monitors and controls all functions within the system.

Figure 3:
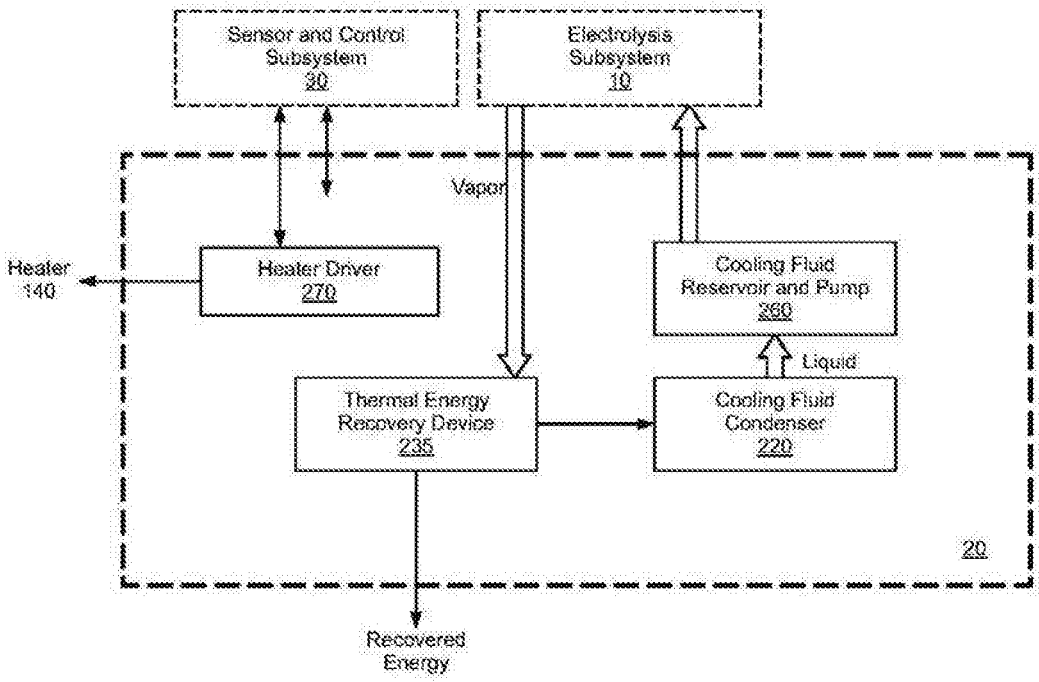
FIG. 3 shows a functional block diagram of the thermal management subsystem 20 comprised of a thermal energy recovery device 235 including a cooling fluid condenser 220 and a cooling fluid reservoir and pump 260. Also included in the thermal management subsystem is a heater driver 270.

FIG. 3 illustrates a functional block diagram of the thermal management subsystem (20) which supplies cooling fluid to the electrolysis subsystem (10). Since the electrolysis reactor is at a higher temperature than that required for a phase change from liquid to vapor, (100 degrees C. in the case of water at 1 atmosphere pressure if water is used as the cooling fluid), the heat of vaporization is used as a means to transfer heat from the working electrode as the vapor. This nonlinear phase change is an important control mechanism to control the multiple nonlinear processes and reactions releasing heat in the working electrode. The resulting high-temperature vapor is transported via a pipe to the thermal management subsystem where the heat energy is extracted by one of several well-known heat energy recovery devices (235) an example of a thermal energy recovery device would be a steam turbine or thermoelectric generator, or a Rankin engine to generate electricity. The remaining vapor goes through the cooling fluid condenser (220) and the cooling fluid reservoir and pump (260) where it is available for recycle to the electrolysis reactor subsystem. The waste heat from the heat of condensation could be available for applications that can use such heat. The thermal management subsystem also provides the heater driver (270) to the reaction vessel heater (140) under control by the sensor and control subsystem.

Figure 4:
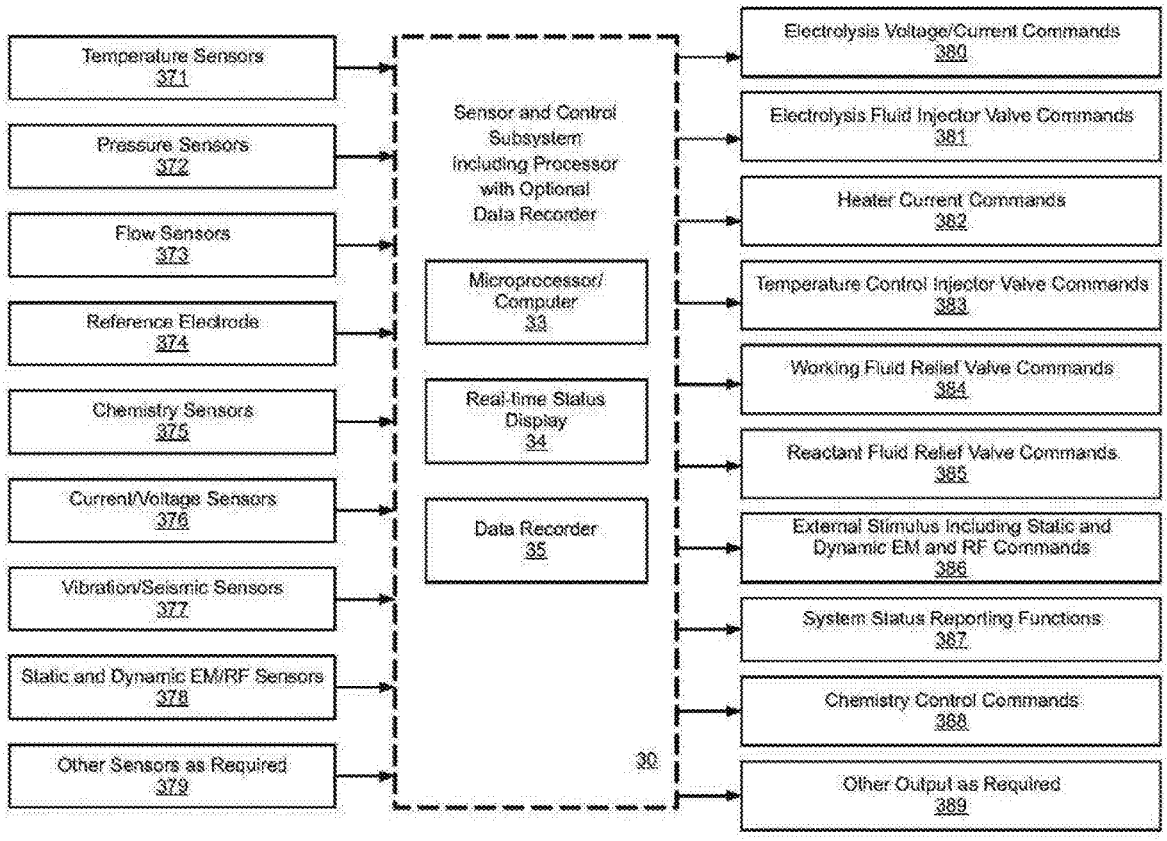
FIG. 4 shows a functional representation of a sensor and control subsystem, 30 including a processor (33) with a real-time status display (34) with optional data recorder 35 and a plurality of input sensors and output controls.

FIG. 4 illustrates a functional block diagram of the sensor and control subsystem (30), a real-time status display (34), and with optional data recorder (35). The sensor and control subsystem receives input from a plurality of sensors monitoring the operation of the system which are analyzed by a processor/computer (33) which in turn provides output signals to control and maintain the Electrolysis Reactor System (1) and associated systems within the desired operational parameters. The sensor and control subsystem includes:

(a) a plurality of sensors placed as required throughout the system to measure and report operational information including but not limited to one or more of the following types of sensors:

Temperature sensors such as but not limited to thermocouples, thermisters, RTD's, pyroelectric, and infrared sensors, (371); pressure sensors, (372); flow sensors (373); reference electrode (374); chemistry sensors, (375) for example pH, ionic concentration, or chemical ion sensors; current and voltage sensors (376); vibration/seismic sensors (377); static and dynamic electromagnetic sensors (378) including RF sensors; and other sensors as required (379).

(b) an electronic processor (33) including software and hardware controls as required for the operation and control of the system. This includes electronic systems to analyze the sensor information and calculate and provide feedback control signals to components of the Electrolysis Reactor System. Such systems will include the ability to control the multiple nonlinear processes involved. Such algorithms can also include control of chaos using techniques that are well-known in the art. See for example: "Taming Chaotic Dynamics with Weak Periodic Perturbations" by Braimam and Goldhirsch, Phys Rev Letters V 66, Number 20, May 1991 pp 2545-2548, and "Continuous control of chaos by self-controlling feedback" by Pyragas, Physics Letters A, 170 (1992) 421-428, and "Delayed feedback control of chaos" by Pyragas, Phil. Trans. R. Soc. A(2006)364, 2309-2334 all herein incorporated by reference.

(c) a number and variety of control signals including but not limited to one or more: Signals to control the thermal management subsystem (20) including the cooling system controlling the fluid injection rate into the heat transfer plenum (383), to maintain the reactor subsystem within the desired temperature and pressure ranges, for example a signal going to control valve (143); a signal (382) going to the heater driver (270) to control heater (140) to increase temperature of the working and/or counter-electrodes with for example heating tape or other suitable devices to initiate and/or sustain the reactions.

A signal (380) to adjust the electrical potential and current between the counter-electrode and working electrode including the ability to reverse the current to control the loading and deloading (release) of hydrogen in the working electrode. This includes the ability to control the hydrogen flux into and out of the working electrode.

A signal (381) to control the ionized fluid liquid or vapor injector to inject ionized fluid droplets of electrolyte into the reaction chamber (117).

A signal (386) to control external stimuli for example magnetic fields and/or an electromagnet to generate static and/or dynamic electromagnetic fields including radio frequency fields, vibration, sonic, and ultrasonic generators, and a plasma field generator to supply a plasma of ions.

A signal (384) controlling the working fluid relief valve.

A signal (385) controlling the hydrogen reactant relief valve.

A signal (387) providing information to a real-time status display system (34) to monitor the performance of the system and provide alerts in the event that performance parameters exceed control limits.

A signal (388) controlling the chemistry system for example but not limited to controlling the pH of the electrolyte which is an indication of the H-ion concentration.

Signals as necessary (389) to other components as needed.

(d) An optional data recorder (35) for producing an archival record of the state of the system as a function of time.

Figure 5:
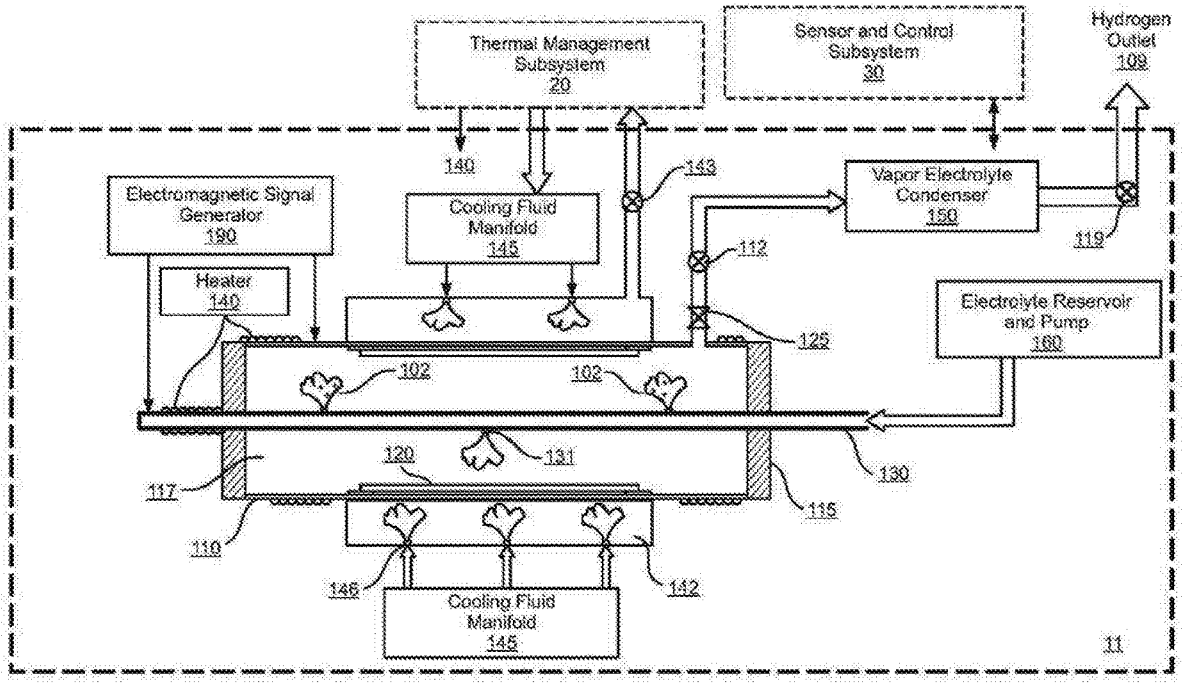
FIG. 5 shows a cross-section schematic view of an embodiment of an electrolysis subsystem 11 that uses a liquid/vapor electrolyte.

FIG. 5 illustrates the components of an embodiment of an electrolysis subsystem in cross section (11) which in conjunction with the thermal management subsystem (20) and the sensor and control subsystem (30) makes up the electrolysis system (10). The electrolysis subsystem (11) includes:

(a) an electrolysis reactor vessel (110) containing a chamber (117) which contains the hydrogen ion electrolyte, (102) for example steam, water vapor and other hydrogen containing vapors. The vapors can also contain ions such as lithium, nickel and palladium and in this embodiment also help provide electrical conductivity to the working electrode (120), which also incorporates a hydrogen diffusion barrier to prevent hydrogen from diffusing out of the back side of the working electrode material. The reactor vessel also serves as a hydrogen diffusion barrier to prevent hydrogen from diffusing out of the chamber (117). Examples of a hydrogen diffusion barrier would include copper and stainless steel.

(b) A hydrogen host material positioned within the reactor vessel forming a working electrode (120). See FIGS. 9-12 and 33, for examples of working electrode embodiments and configurations.

(c) a counter-electrode (130) preferably of non-reacting platinum or other suitable material positioned within the reactor vessel which is electrically isolated from the working electrode by an electrical insulated feed-through (115). Such counter-electrode may include one or more electrolyte injectors (131) which may further ionize the electrolyte as the hydrogen ion electrolyte (102) is injected into the reaction vessel chamber (117).

(d) an electromagnetic signal generator (190) as shown in FIG. 22 where:

i) the direct current or low frequency electric field such as that produced by a galvanostat/potentiostat transports the hydrogen ions toward the working electrode;

ii) and provides the electrical potential that galvanically and/or galvanistatically compresses the hydrogen ions into the crystal lattice sites in working electrode materials;

iii) and may provide alternating current electromagnetic stimulation, including but not limited to radio frequency energy that interacts with the hydrogen and host material atoms in the working electrode.

(e) a heat-transfer plenum (142) surrounding the reactor vessel which includes:

i) one or more cooling fluid injectors (146) to inject liquid (mist) cooling fluid at a controlled rate into the heat transfer plenum (142) where it undergoes a phase change from liquid to vapor to control and maintain the desired temperature, for example between 250 C and 700 C in the working electrode;

ii) a control valve (143) for the controlled release of the heated vapor from the plenum to the thermal management subsystem (20).

(f) a cooling fluid manifold (145) that receives the cooling fluid from the thermal management subsystem (20) and distributes it in a controlled release to the cooling fluid injectors (146) into the heat transfer plenum (142).

(g) an oxygen separator/recombiner (125) to separate and/or recombine the oxygen-rich remaining electrolyte vapor from the reactor vessel such as:

i) an oxygen separator to separate and remove the remaining oxygen from the electrolyte vapor and/or ii) a fuel cell or platinum grid to recombine the excess oxygen and the residual hydrogen in the electrolyte vapor iii) and/or an electrical discharge plasma or spark generator to burn the excess oxygen and residual hydrogen.

(h) an electrolyte relief valve (112) that maintains the pressure of the electrolyte vapor that is within the rated working pressure of the reactor vessel (110).

(i) a vapor electrolyte condenser (150) and an electrolyte reservoir and pump (160) to cool and recycle the electrolyte.

(j) a heater (140) to heat the reactor vessel including the counter-electrode and the working electrode to the desired working temperature.

(k) a hydrogen outlet (109) with a hydrogen relief valve (119). The hydrogen is available for any application requiring hydrogen.

Figure 6:
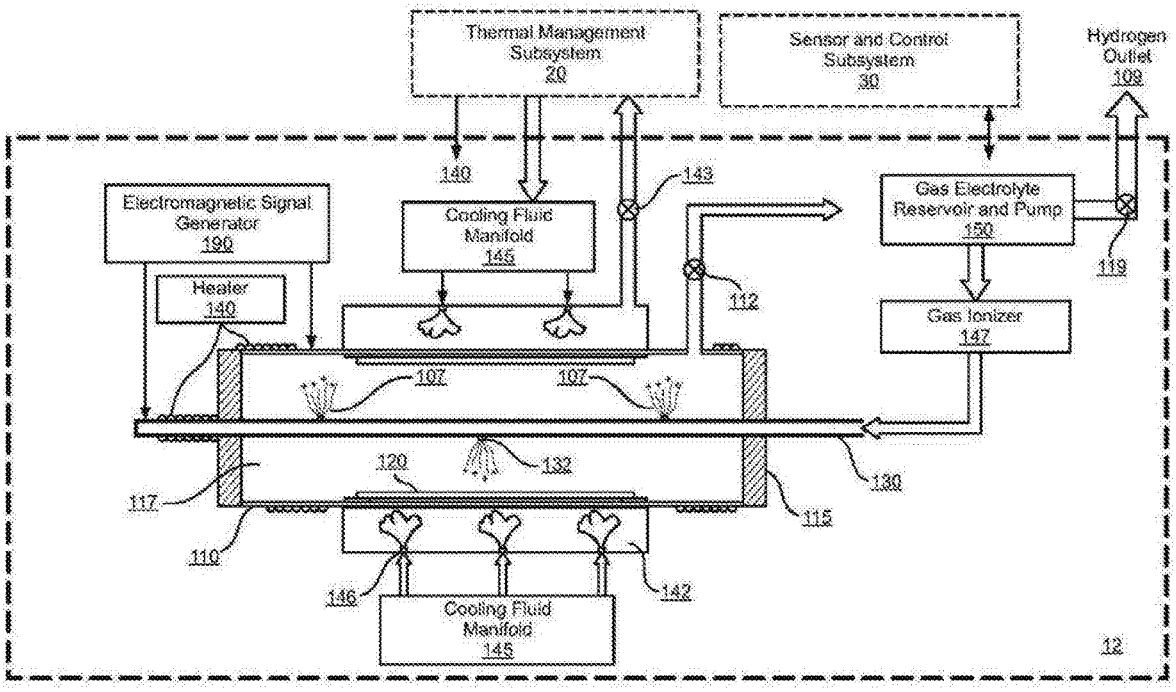
FIG. 6 shows a cross-section schematic view of an alternate embodiment of a electrolysis subsystem 12 that uses an ionized gas electrolyte.

FIG. 6 illustrates the components of an alternate gas-electrolyte embodiment of the invention, showing a gas electrolyte electrolysis subsystem (12) which in conjunction with the thermal management subsystem (20) and the sensor and control subsystem (30) makes up the electrolysis system (10). The gas electrolyte embodiment cross section (12) includes:

(a) an electrolysis reactor vessel (110) containing a chamber (117) which contains the hydrogen ion gas electrolyte (107), for example ionized hydrogen gas or HCl vapor and which in this embodiment the ionized vapor also provides electrical conductivity to the working electrode (120), which also incorporates a hydrogen diffusion barrier to prevent hydrogen from diffusing out of the back side of the working electrode material. The reactor vessel also serves as a hydrogen diffusion barrier to prevent hydrogen from diffusing out of the back side of the working electrode material. Examples of a hydrogen diffusion barrier would include copper and stainless steel.

(b) a hydrogen host material positioned within the reactor vessel forming a working electrode (120) with alternate embodiments shown in FIGS. 9-12 and 33, (c) a counter-electrode (130) preferably of non-reacting platinum or other suitable material positioned within the reactor vessel which is electrically isolated from the working electrode by an insulated feed-through (115). Such counter-electrode may include one or more hydrogen gas-electrolyte injectors (132) for dispersing the hydrogen ion gas electrolyte (107) into the reaction chamber (117).

(d) an electromagnetic signal generator (190) as shown in FIG. 22 where:

i) the direct current or low frequency electric field such as that produced by the electromagnetic signal generator (190) which transports the hydrogen ions toward the working electrode ii) and provides the electrical potential that galvanically and/or galvanistatically compresses the hydrogen ions into the crystal lattice sites in working electrode materials.

iii) and may provide alternating current electromagnetic stimulation, including but not limited to radio frequency energy that interacts with the hydrogen and host material atoms in the working electrode.

(e) a heat-transfer plenum (142) surrounding the reactor vessel which includes:

i) one or more cooling fluid injectors (146) to inject liquid (mist) cooling fluid at a controlled rate into the plenum to control and maintain the desired temperature, for example between 250 C and 700 C in the working electrode.

ii) a control valve (143) for the controlled release of the heated vapor from the plenum to the thermal management subsystem (20).

(f) a cooling fluid manifold (145) that receives the cooling fluid from the thermal management subsystem and distributes it in a controlled release to the cooling fluid injectors (146) into the heat transfer plenum (142), (g) an electrolyte relief valve (112) that maintains the safe pressure of the hydrogen gas electrolyte within the rated working pressure of the reactor vessel (h) a gas electrolyte reservoir and pump (161) to recycle the electrolyte to a hydrogen gas ionizer (147). One example of gas ionization uses Am-241 which emits high energy alpha particles at approximately 5.48 MeV. These high energy alphas will strip off electrons from the gaseous hydrogen molecule, dissipating approximately 13.6 eV per electron so one alpha particle can strip many thousand electrons thereby creating many more hydrogen+ions than alpha particles and those ions can create additional ions as they gain energy as they are attracted to the working electrode. Another example is a plasma tube in which hydrogen molecules are ionized by a high voltage electric field. The hydrogen gas ionization can also be located inside the reaction vessel chamber (117).

(i) a heater (140) to heat the reactor vessel including the counter-electrode and the working electrode to the desired working temperature.

(j) a hydrogen outlet (109) with a hydrogen relief valve (119). The hydrogen is available for any application requiring hydrogen.

Figure 7:
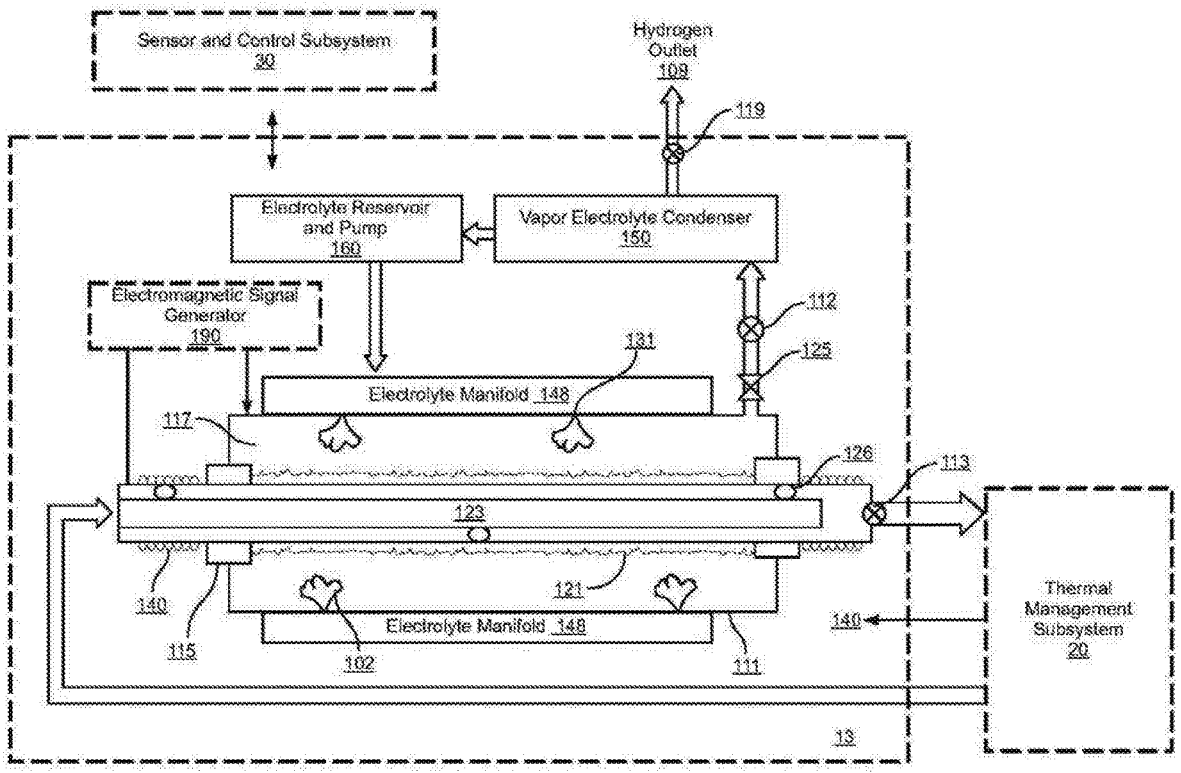
FIG. 7 shows a cross-section schematic view of another alternate embodiment of a electrolysis subsystem 13 that utilizes a different arrangement of the electrodes.

FIG. 7 illustrates the components of an alternate reactor vessel/electrode configuration embodiment of the electrolysis subsystem (13) which in conjunction with the thermal management subsystem (20) and the sensor and control subsystem (30) makes up the electrolysis system (10). The alternative reactor vessel/electrode configuration embodiment (13) includes:

(a) an electrolysis reactor vessel (111) which in this embodiment also serves as the counter-electrode. The counter-electrode includes one or more electrolyte injectors (131) for dispersing the hydrogen ion electrolyte (102).

(b) a working electrode (121) positioned inside the reactor vessel comprised of a hydrogen host material with alternate configurations as shown in FIGS. 9-12.

(c) the counter-electrode (electrolysis reactor vessel (111)) and the working electrode (121) are electrically isolated by electrically insulated feed-throughs (115).

(d) an electromagnetic signal generator (190) for example similar to the one shown in FIG. 22 where:

i) the direct current or low frequency electric field such as that produced by a galvanostat/potentiostat transports the hydrogen ions toward the working electrode ii) and provides the electrical potential that galvanically and/or galvanistatically compresses the hydrogen ions into the crystal lattice sites in working electrode materials iii) and may provide alternating current electromagnetic stimulation, including but not limited to radio frequency energy that interacts with the hydrogen and host material atoms in the working electrode.

(e) an electrolyte manifold (148) that injects the hydrogen ion electrolyte (102) into the reaction vessel.

(f) an oxygen separator/recombiner (125) for separation and/or recombination of the oxygen-rich remaining electrolyte vapor from the reactor vessel for example:

i) an oxygen separator to separate the oxygen formed from the electrolysis from the electrolyte vapor and/or ii) a hydrogen recombiner to recombine residual hydrogen with the oxygen formed from electrolysis in the electrolyte vapor for example a platinum grid.

iii) and/or an electrical discharge plasma or spark generator to burn the residual hydrogen with the excess oxygen.

(g) an electrolyte relief valve (112) that maintains the desired pressure of the electrolyte vapor in the reactor vessel (h) a vapor electrolyte condenser (150) and an electrolyte reservoir and pump (160) to cool and recycle the electrolyte into the electrolyte manifold (148).

(i) a heater (140) to heat the reactor vessel including the counter-electrode and the working electrode.

(j) a pipe or a tube (123) with support structure and with one or more injector ports and/or a porous pipe to disperse a controlled flow of cooling fluid to cool the working electrode.

(k) a thermal management control valve (113) to maintain pressure and temperature controls within the working electrode.

(l) a hydrogen outlet (109) with a hydrogen relief valve (119).

Figure 8A:
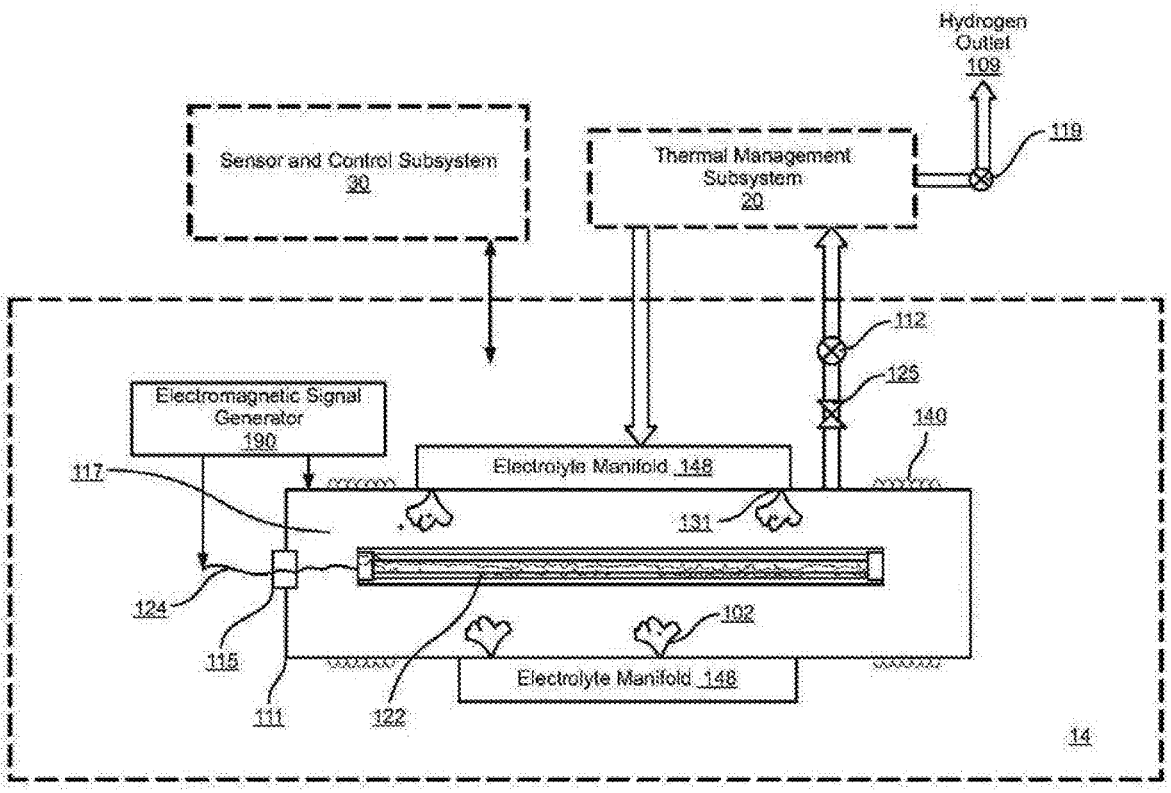
FIG. 8*a* shows a cross-section schematic view of another alternate embodiment of an electrolysis subsystem 14 that utilizes an alternate working electrode configuration and combines the functions of the cooling fluid and the electrolyte.

FIG. 8*a* illustrates the components of an alternate reactor vessel/electrode configuration embodiment of the electrolysis subsystem (14) that combines the functions of the cooling fluid and which in conjunction with the thermal management subsystem (20) and the sensor and control subsystem (30) makes up the electrolysis system (10). The alternative reactor vessel/electrode configuration embodiment (14) includes:

(a) an electrolysis reactor vessel (111) which in this embodiment also serves as the counter-electrode. Such counter-electrode includes one or more electrolyte injectors (131) for dispersing the hydrogen ion electrolyte (102).

Figure 13:
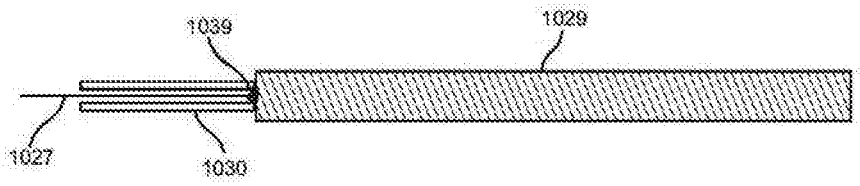
FIG. 13 shows a bulk hydrogen host material working electrode cross-section detail.
Figure 14:
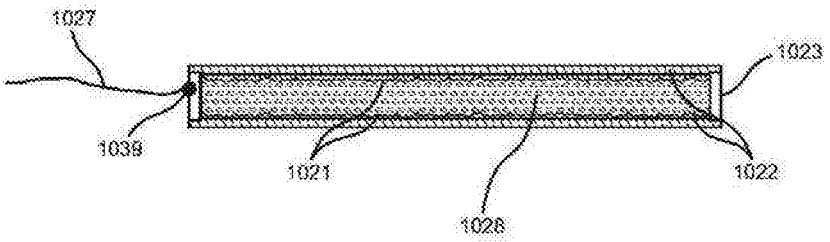
FIG. 14 shows the cross-section detail of a two-sided hydrogen-permeable-membrane deposit-enhanced composite working electrode.

(b) a working electrode (122) positioned inside the reactor vessel, an example of such as shown in FIGS. 13 and 14.

(c) the counter-electrode (electrolysis reactor vessel (111)) and the working electrode (122) are electrically isolated by an electrically insulated feed-through (115).

(d) an electromagnetic signal generator (190) where:

i) the direct current or low frequency electric field such as that produced by a galvanostat/potentiostat transports the hydrogen ions toward the working electrode ii) and provides the electrical potential that galvanically and/or galvanistatically compresses the hydrogen ions into the crystal lattice sites in working electrode materials.

iii) and may provide alternating current electromagnetic stimulation, including but not limited to radio frequency energy that interacts with the hydrogen and host material atoms in the working electrode.

(e) an electrolyte manifold (148) that injects the hydrogen ion electrolyte (102) into the reaction vessel.

(f) an oxygen separator/recombiner (125) for separation and/or recombination of the oxygen-rich remaining electrolyte vapor from the reactor vessel including:

i) an oxygen separator to separate the oxygen formed from the electrolysis from the electrolyte vapor and/or ii) a hydrogen recombiner to recombine residual hydrogen with the oxygen formed from electrolysis in the electrolyte vapor for example a platinum grid, and/or iii) an electrical discharge plasma or spark generator to burn the excess oxygen and residual hydrogen (g) an electrolyte relief valve (112) that maintains the desired pressure of the electrolyte vapor in the reactor vessel (h) a thermal management subsystem (20) to cool and recycle the electrolyte (102) into the electrolyte manifold (148) for injection by the electrolyte injectors (131).

(i) a heater (140) to heat the reactor vessel including the counter-electrode and the working electrode.

(j) a hydrogen outlet (109) with a hydrogen relief valve (119).

Figure 8B:
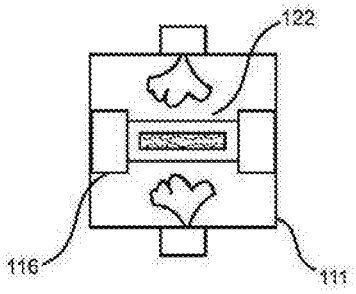
FIG. 8*b* shows the end view of the reactor vessel included in FIG. 8*a*.

FIG. 8*b* illustrates the end view cross section of the reactor vessel (111) as shown in FIG. 8*a* illustrating a support system for the working electrode (122) which is electrically insulating, and which optionally can be non-magnetic supports (116).

Figure 9:
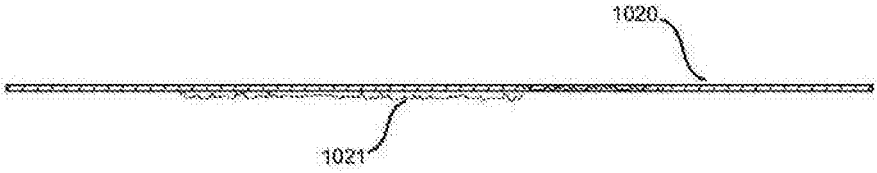
FIG. 9 shows a representative deposited hydrogen host material working electrode cross-section detail.

FIG. 9 illustrates a cross-section view of a working electrode in which a hydrogen host material for example palladium or nickel (1021) is deposited onto an electrically conducting, low hydrogen-permeability base material for example copper, stainless steel, gold plated copper or gold plated stainless steel (1020).

Figure 10:
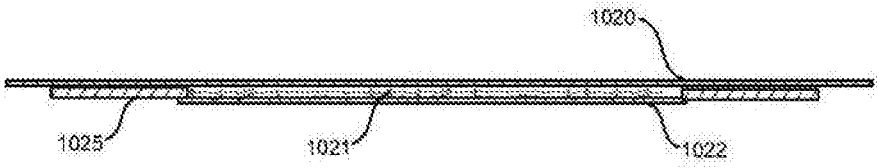
FIG. 10 shows a representative hydrogen-permeable-membrane protected deposited-material, working electrode cross-section detail.

FIG. 10 illustrates a cross-section view of working electrode in which the deposited hydrogen host material (1021) is deposited onto an electrically conducting, low hydrogen-permeability base material (1020) which is covered by an electrically conductive hydrogen-permeable membrane for example palladium or palladium-silver alloy (1022) and sealed on the ends to contain the hydrogen by hydrogen diffusion barriers (1025).

Figure 11:
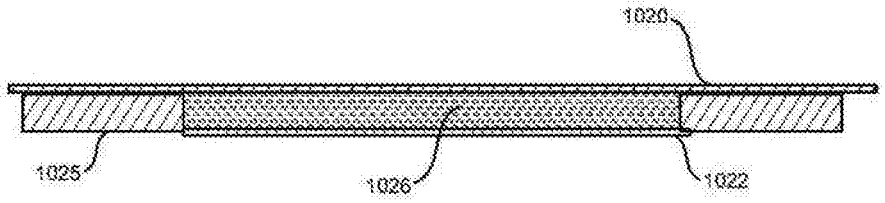
FIG. 11 shows an example of an electrically-conducting hydrogen-permeable-membrane composite working electrode cross-section detail.

FIG. 11 illustrates a cross-section view of a composite working electrode comprised of an electrically conducting, low hydrogen-permeable base material (1020) on which particulate hydrogen host material, for example particles of nickel, palladium, Ni/zirconium oxide, or Pd/zirconium oxide (1028) are placed in a volume between the base material (1020) and a hydrogen permeable membrane (1022) and sealed on the ends to contain the hydrogen by low hydrogen diffusion barrier materials (1025).

Figure 12:
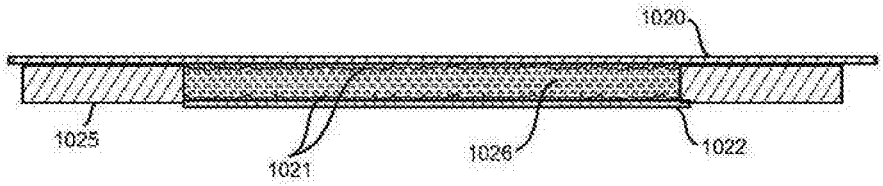
FIG. 12 shows a hydrogen-permeable-membrane, deposit-enhanced composite working electrode cross-section detail.

FIG. 12 illustrates a cross-section view of a composite working electrode shown in FIG. 11 with the addition of a deposited hydrogen host material (1021) that is deposited onto the electrically conducting, low hydrogen permeability base material (1020).

FIG. 13 illustrates a cross-section view of a bulk hydrogen host material (1026) for example palladium, nickel or NiTi-NOL with an electrically insulated low-hydrogen permeable electrical conductor (1027) which is mechanically and electrically connected to the working electrode which is the bulk hydrogen host material (1029) for example by a spot-weld (1039). It may include an electrolyte impermeable, electrical insulation (1030).

FIG. 14 illustrates a cross section view of a two-sided hydrogen-permeable-membrane deposit enhanced composite working electrode comprised of an electrically conducting hydrogen-permeable-membrane (1022) on which a deposited hydrogen host material (1021) is deposited and contains a hydrogen host particulate material (1028) with an electrical conducting, mechanical connection (1039) for example a spot weld to a low hydrogen permeable electrical conductor (1027).

Figure 15:
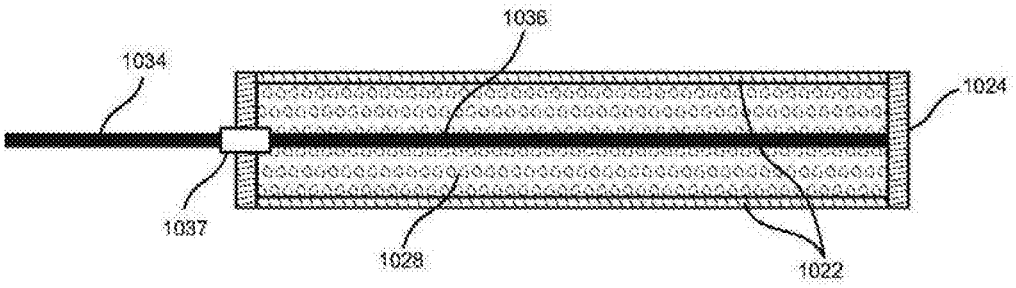
FIG. 15 shows the cross-section detail of a two-sided hydrogen-permeable-membrane working electrode.

FIG. 15 illustrates a cross-section view of a two sided hydrogen permeable membrane composite working electrode in which an electrical wire or mesh conductor for example silver, copper, nickel, or stainless steel (1036) is surrounded by the particulate hydrogen host material (1028) and contained by an electrically conducting hydrogen permeable membrane (1022) in conjunction with electrically insulating hydrogen and particulate containment barriers for example commercially available glass or ceramic materials (1024). The electrical conductor (1036) is mechanically and electrically connected to a low hydrogen permeable penetrator/seal, with electrical conductor feed-through (1037) and attached on the outside of the working electrode to a low hydrogen permeable wire such as but not limited to silver or copper (1034).

Figure 16:
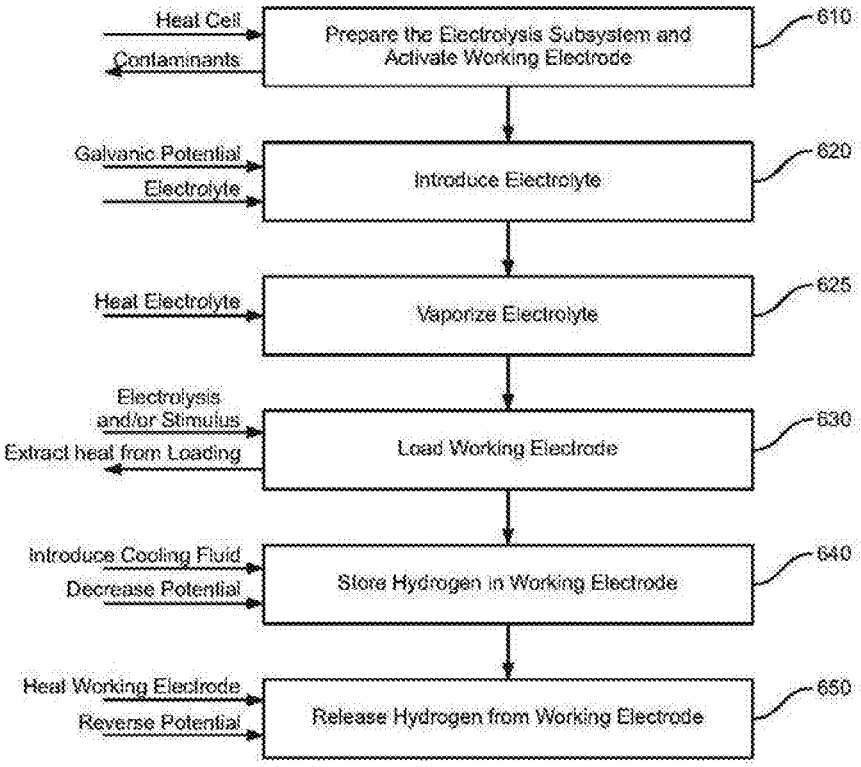
FIG. 16 shows a functional flow diagram of the procedures to operate the electrolysis reactor system for the production, safe storage, and release of hydrogen.

FIG. 16 is a block diagram of the critical steps to load, store, and release hydrogen. The initial step (610) is to prepare the electrolysis subsystem by purging the electrolysis reactor vessel including the working electrode for example by heating the subsystem while under vacuum to remove contaminants. In step (620), galvanic potential is applied and the electrolyte is introduced into the prepared system. In step (625), additional heat is added as required to vaporize the electrolyte and increase the diffusivity and permeability of the hydrogen host working electrode material. In step (630), electrolysis is initiated by adjusting the galvanic current flow and external stimulus, if required, is applied to load the working electrode with the hydrogen reactant. Since heat can be produced in a working electrode during the loading process, the temperature of the working electrode is monitored by the sensor and control subsystem and maintained at the desired temperature by the thermal subsystem. When the sensor and control subsystem indicates that the desired amount of hydrogen is loaded into the working electrode, in step (640), storage is achieved by cooling the working electrode to reduce diffusivity and after the working electrode is cooled, the electrolysis potential may be reduced. In order to release hydrogen, the working electrode can be heated to increase diffusivity and/or the electrolysis potential reversed to drive the hydrogen out of the working electrode in step (650).

Figure 17:
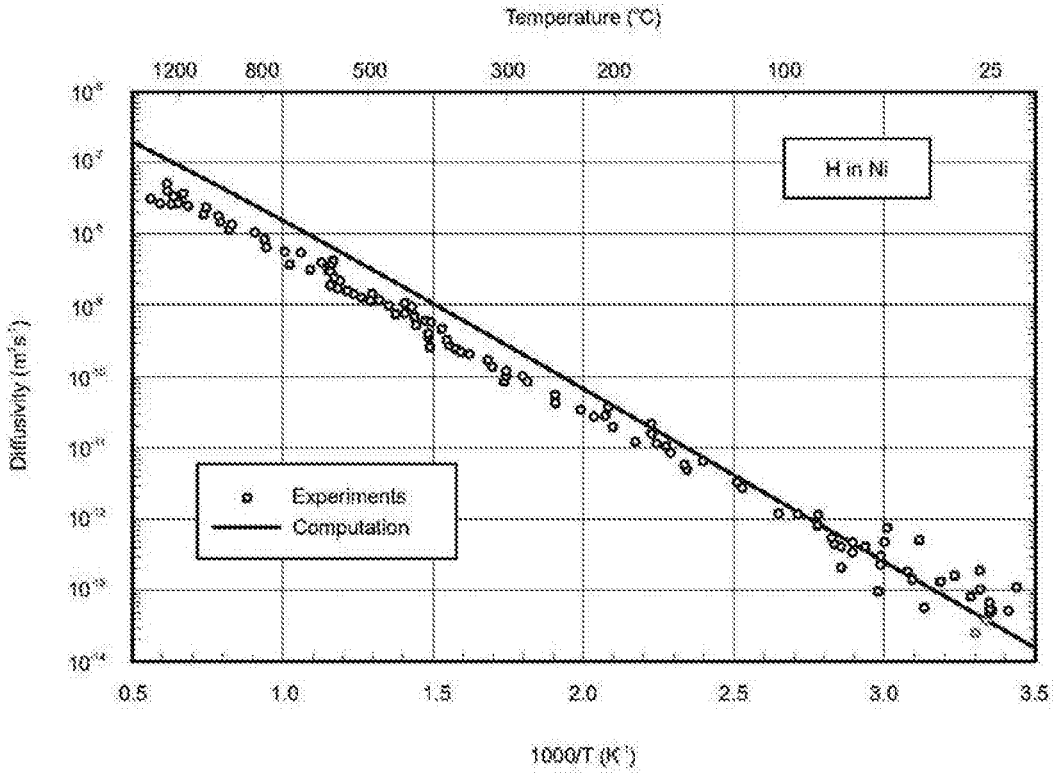
FIG. 17 is a graph illustrating the diffusion of hydrogen in nickel as a function of temperature.

FIG. 17 is a graph illustrating the increased diffusion of hydrogen in nickel as a function of temperature from E. Wimmer, W. Wolf, J. Sticht, P. Saxe, C. B. Geller, R. Najafabadi, and G. A. Young, "Temperature-dependent diffusion coefficients from ab initio computations: Hydrogen in nickel", Phys Rev B77, 134305 2008 see also http://www.osti.gov/scitech/servlets/purl/881301 herein incorporated by reference.

Figure 18:
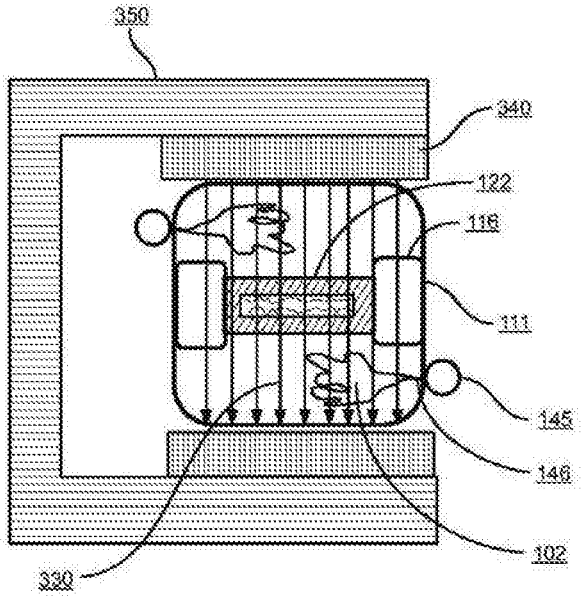
FIG. 18 illustrates a cross section of the reactor vessel (111) as shown in FIG. 8*a* illustrating magnetic lines of flux.

FIG. 18 illustrates a cross section of the reactor vessel (111) as shown in FIG. 8*a* illustrating an electrically insulating, non-magnetic support system (116) for the working electrode (122) having manifold (145), injectors (146) and hydrogen ion electrolyte (102). The reactor vessel (111) is between two magnets (340) which are held in place by a low-reluctance magnetic keeper (350). A portion of the magnetic field lines are illustrated by magnetic field lines (330).

Figure 19:
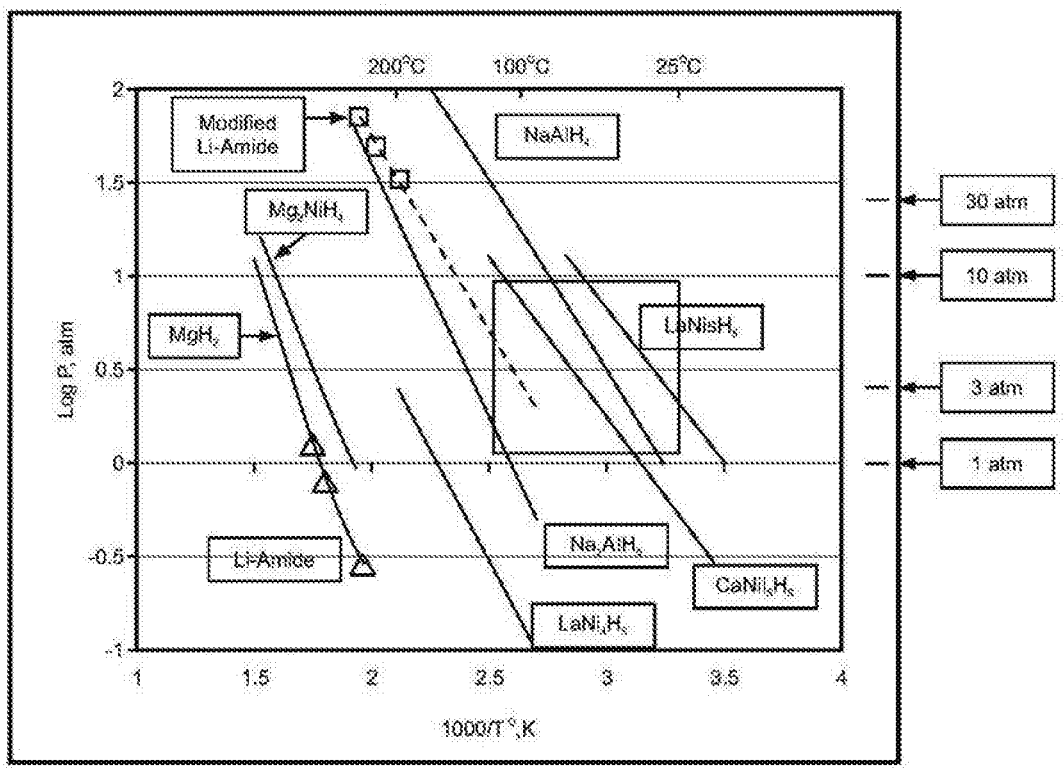
FIG. 19 illustrates selected optimal temperature vs. pressure ranges for various metal hydrides.
Figure 20:
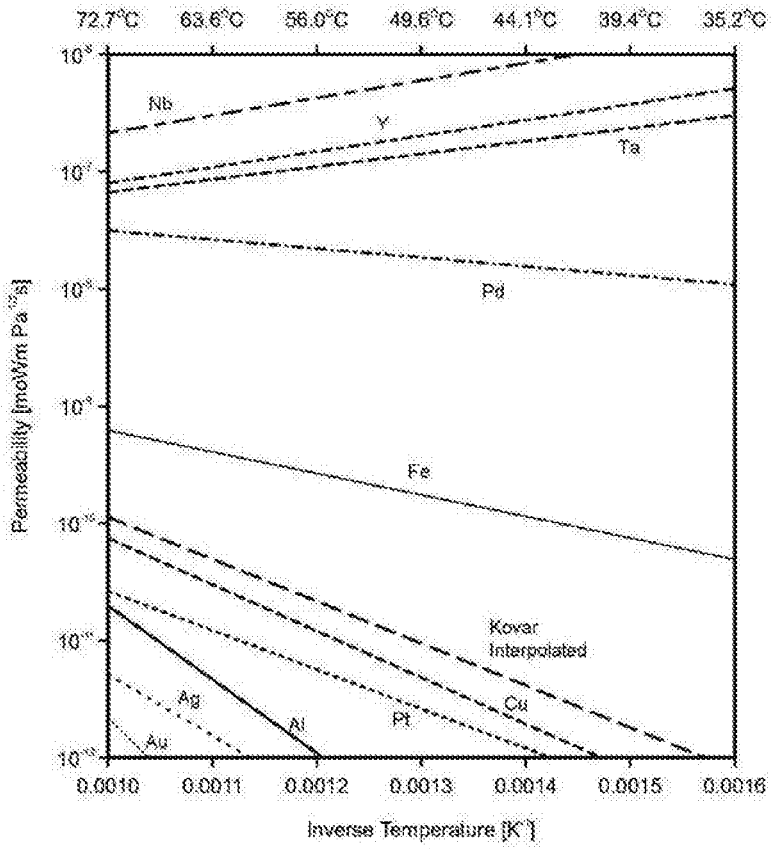
FIG. 20 illustrates the permeability of selected metals (excluding stainless steel) to hydrogen as a function of temperature.

FIG. 19 illustrates the increase in temperature as pressure is increased to load hydrogen into selected metal hydrides as shown from http://www1.eere.energy.gov/hydrogenandfuelcells/storage/metal_hydrides.html and DOE Metal hydrides. eere.energy.gov (2008 Dec. 19). Retrieved on 2012 Jan. 8, herein incorporated by reference FIG. 20 illustrates the permeability of selected metals (excluding stainless steel) to hydrogen as a function of temperature which is important for the design of a low hydrogen permeable barrier as seen in Gillette and Kolpa "Overview of Interstate Pipeline Systems" Argonne National Labs Report ANL/EVS/TM/08-2 (2007), see also http://www.rebresearch.com/H2perm2.htm herein incorporated by reference.

Figure 21:
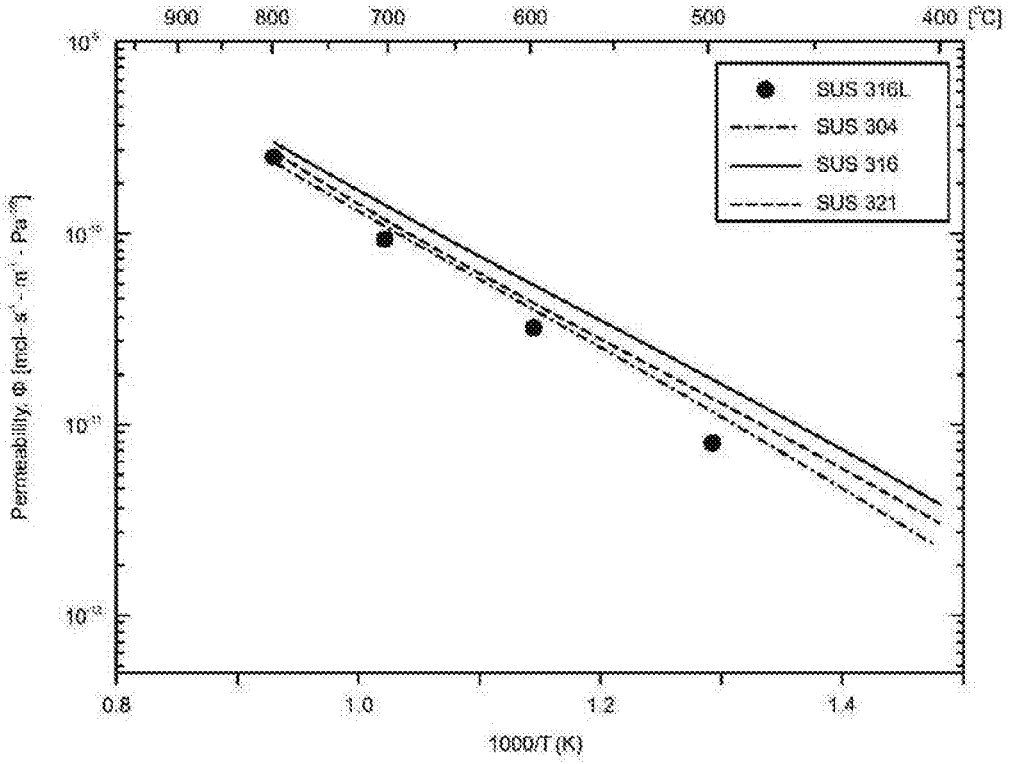
FIG. 21 illustrates the permeability of a selection of stainless steels to hydrogen as a function of temperature
Figure 22A:
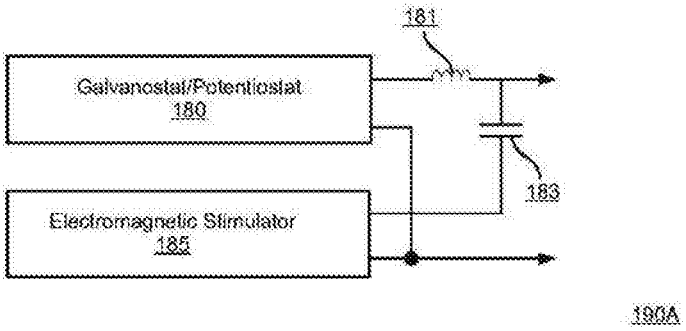
FIG. 22 illustrates a functional block diagram/schematic of two representative embodiments of an electromagnetic signal generator.
Figure 22B:
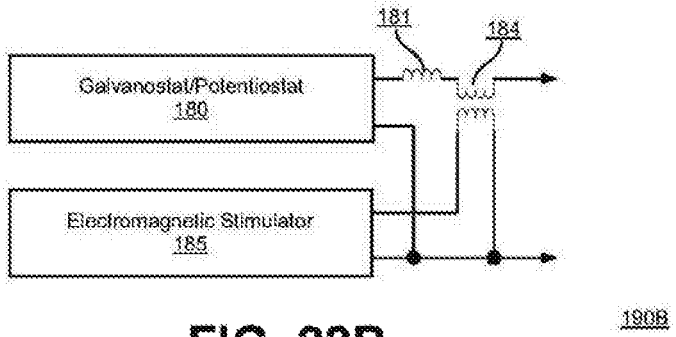

FIG. 21 illustrates the permeability of a selection of stainless steels to hydrogen as a function of temperature which is seen to be similar to that of copper as seen in Lee, S. K. et al, "Hydrogen Permeability, Diffusivity, and Solubility of SUS 316L Stainless Steel in the Temperature Range 400 to 800 C for Fusion Reactor Applications" Journal of the Korean Physical Society, Vol. 59, No. 5, November 2011, pp. 3019-3023 herein incorporated by reference FIG. 22 shows a functional block diagram of two representative implementations of the many implementations known to those skilled in the art of electronic design of an electromagnetic signal generator (190*a*) and (190*b*) where the direct current or low frequency electric field for example that produced by a galvanostat/potentiostat (180) that transports the hydrogen ions toward the working electrode and is isolated from the electromagnetic stimulator (185) by either a capacitor (183) as shown in FIG. 22*a* or a transformer (184) as shown in FIG. 22*b*. The electromagnetic stimulator (185) is isolated from the direct or low frequency electric signal generator by an RF choke (181) including but not limited to radio frequency energy that interacts with the hydrogen and host material atoms in the working electrode.

Figure 23:
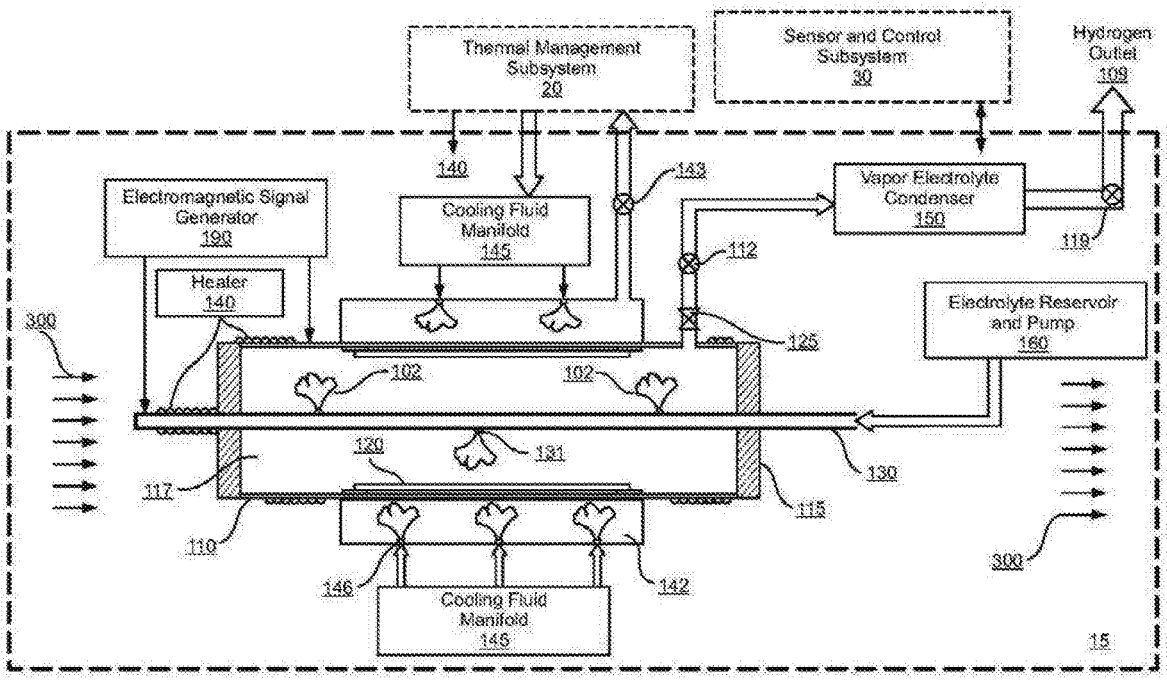
FIG. 23 shows a cross-section schematic view of a preferred embodiment of a electrolysis subsystem 15 that uses a liquid/vapor electrolyte and includes the presence of a magnetic field.

FIG. 23 shows a cross-section schematic view of an embodiment of an electrolysis subsystem 15 that uses a liquid/vapor electrolyte and includes the presence of a static and/or dynamic axial magnetic field (300). The electrolysis reactor vessel (110) can be made out of non-magnetic material, for example copper or stainless steel in order to facilitate the function of the magnetic field. It should be recognized that the magnetic field can be applied to any of the representative embodiments. A magnetic field strength of 2500 Gauss (0.25 Tesla or Webers/sq. meter) is sufficient. FIG. 23 illustrates the components of an embodiment of an electrolysis subsystem in cross section (15) that uses a liquid/vapor electrolyte and includes the presence of a static and/or dynamic axial magnetic field (300) in conjunction with the thermal management subsystem (20) and the sensor and control subsystem (30) makes up the electrolysis system (10). The electrolysis subsystem (15) includes:

(a) an electrolysis reactor vessel (110) containing a chamber (117) which contains the hydrogen ion electrolyte, (102) for example steam, water vapor and other hydrogen containing vapors. The vapors can also contain ions such as lithium, nickel and palladium and in this embodiment also help provide electrical conductivity to the working electrode (120), which also incorporates a hydrogen diffusion barrier to prevent hydrogen from diffusing out of the back side of the working electrode material. The reactor vessel also serves as a hydrogen diffusion barrier to prevent hydrogen from diffusing out of the back side of the working electrode material. Examples of a hydrogen diffusion barrier would include copper and stainless steel.

(b) A hydrogen host material positioned within the reactor vessel forming a working electrode (120). See FIGS. 9-12 and 33, for examples of working electrode embodiments and configurations.

(c) a counter-electrode (130) preferably of non-reacting platinum or other suitable material positioned within the reactor vessel which is electrically isolated from the working electrode by electrically insulated feed-throughs (115). Such counter-electrode may include one or more electrolyte injectors (131) which may further ionize the electrolyte as the hydrogen ion electrolyte (102) is injected into the reaction vessel chamber (117).

(d) an electromagnetic signal generator (190) as shown in FIG. 22 where:

i) the direct current or low frequency electric field such as that produced by a galvanostat/potentiostat transports the hydrogen ions toward the working electrode;

ii) and provides the electrical potential that galvanically and/or galvanistatically compresses the hydrogen ions into the crystal lattice sites in working electrode materials;

iii) and may provide alternating current electromagnetic stimulation, including but not limited to radio frequency energy that interacts with the hydrogen and host material atoms in the working electrode.

(e) a heat-transfer plenum (142) surrounding the reactor vessel which includes:

i) one or more cooling fluid injectors (146) to inject liquid (mist) cooling fluid at a controlled rate into the plenum where it undergoes a phase change from liquid to vapor to control and maintain the desired temperature, for example between 250 C and 700 C in the working electrode;

ii) a control valve (143) for the controlled release of the heated vapor from the plenum to the thermal management subsystem (20).

(f) a cooling fluid manifold (145) that receives the cooling fluid from the thermal management subsystem (20) and distributes it in a controlled release to the cooling fluid injectors (146) into the heat transfer plenum (142).

(g) an oxygen separator/recombiner (125) to separate and/or recombine the oxygen-rich remaining electrolyte vapor from the reactor vessel such as:

i) an oxygen separator to separate and remove the remaining oxygen from the electrolyte vapor and/or ii) a fuel cell or platinum grid to recombine the excess oxygen and the residual hydrogen in the electrolyte vapor iii) and/or an electrical discharge plasma or spark generator to burn the excess oxygen and residual hydrogen.

(h) an electrolyte relief valve (112) that maintains the pressure of the electrolyte vapor that is within the rated working pressure of the reactor vessel (110).

(i) a vapor electrolyte condenser (150) and an electrolyte reservoir and pump (160) to cool and recycle the electrolyte.

(j) a heater (140) to heat the reactor vessel including the counter-electrode and the working electrode to the desired working temperature.

(k) a hydrogen outlet (109) with a hydrogen relief valve (119). The hydrogen is available for any application requiring hydrogen.

Figure 24:
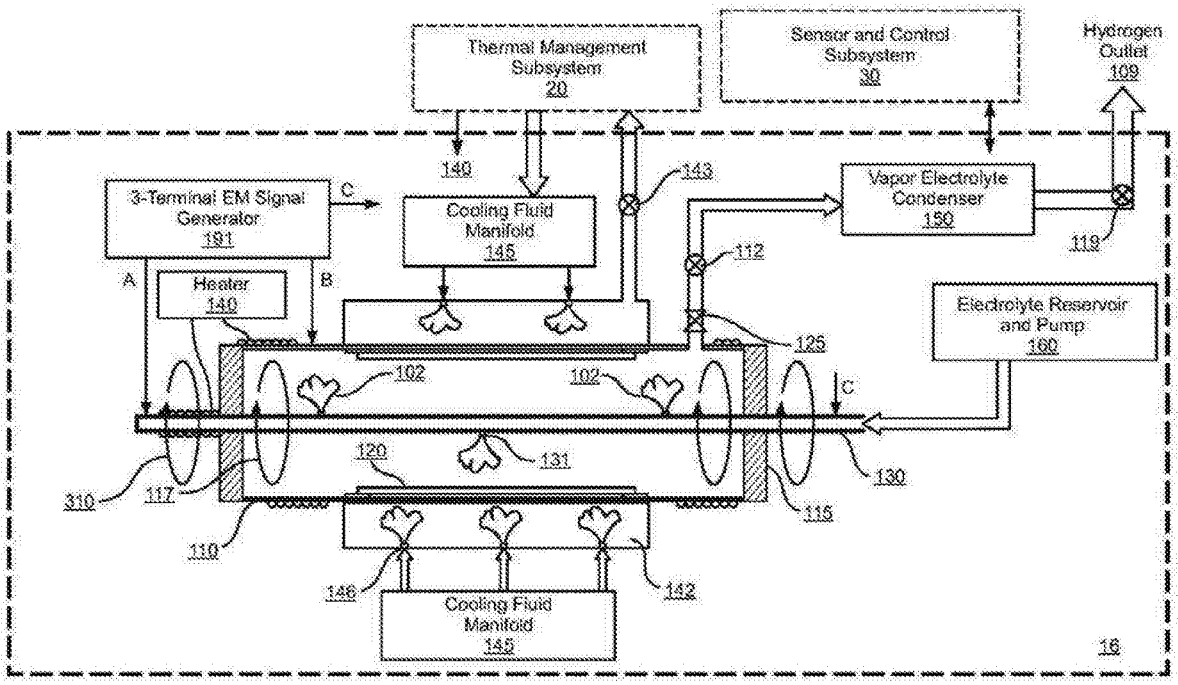
FIG. 24 Electrolysis Subsystem alternate embodiment cross-section with circumferential magnetic field.

FIG. 24 illustrates an Electrolysis Subsystem (16) alternate embodiment cross-section with circumferential, time-varying magnetic field (310). While the field is both inside and outside the reactor vessel (110), only the field inside the reactor vessel that interacts with the electrolysis current is shown. The circumferential magnetic field is generated by an alternating voltage generator and center-tapped current step-up transformer (187) with outputs (A) and (C) shown in FIG. 26. FIG. 24 illustrates the components of an embodiment of an electrolysis subsystem in cross section (16) which in conjunction with the thermal management subsystem (20) and the sensor and control subsystem (30) makes up the electrolysis system (10).

The electrolysis subsystem (16) includes:

(a) an electrolysis reactor vessel (110) containing a chamber (117) which contains the hydrogen ion electrolyte, (102) for example steam, water vapor and other hydrogen containing vapors. The vapors can also contain ions such as lithium, nickel and palladium and in this embodiment also help provide electrical conductivity to the working electrode (120), which also incorporates a hydrogen diffusion barrier to prevent hydrogen from diffusing out of the back side of the working electrode material. The reactor vessel also serves as a hydrogen diffusion barrier to prevent hydrogen from diffusing out of the back side of the working electrode material. Examples of a hydrogen diffusion barrier would include copper and stainless steel.

(b) a hydrogen host material positioned within the reactor vessel forming a working electrode (120). See FIGS. 9-12 and 33, for examples of working electrode embodiments and configurations.

(c) a counter-electrode (130) preferably of non-reacting platinum or other suitable material positioned within the reactor vessel which is electrically isolated from the working electrode by an electrical insulated feed-through (115). Such counter-electrode may include one or more electrolyte injectors (131) which may further ionize the electrolyte as the hydrogen ion electrolyte (102) is injected into the reaction vessel chamber (117).

(d) an electromagnetic signal generator (190) as shown in FIG. 22 where:

i) the direct current or low frequency electric field such as that produced by a galvanostat/potentiostat transports the hydrogen ions toward the working electrode;

ii) and provides the electrical potential that galvanically and/or galvanistatically compresses the hydrogen ions into the crystal lattice sites in working electrode materials;

iii) and may provide alternating current electromagnetic stimulation, including but not limited to radio frequency energy that interacts with the hydrogen and host material atoms in the working electrode.

(e) a heat-transfer plenum (142) surrounding the reactor vessel which includes:

i) one or more cooling fluid injectors (146) to inject liquid (mist) cooling fluid at a controlled rate into the plenum where it undergoes a phase change from liquid to vapor to control and maintain the desired temperature, for example between 250 C and 700 C in the working electrode;

ii) a control valve (143) for the controlled release of the heated vapor from the plenum to the thermal management subsystem (20).

(f) a cooling fluid manifold (145) that receives the cooling fluid from the thermal management subsystem (20) and distributes it in a controlled release to the cooling fluid injectors (146) into the heat transfer plenum (142).

(g) an oxygen separator/recombiner (125) to separate and/or recombine the oxygen-rich remaining electrolyte vapor from the reactor vessel such as:

i) an oxygen separator to separate and remove the remaining oxygen from the electrolyte vapor and/or ii) a fuel cell or platinum grid to recombine the excess oxygen and the residual hydrogen in the electrolyte vapor iii) and/or an electrical discharge plasma or spark generator to burn the excess oxygen and residual hydrogen.

(h) an electrolyte relief valve (112) that maintains the pressure of the electrolyte vapor that is within the rated working pressure of the reactor vessel (110).

(i) a vapor electrolyte condenser (150) and an electrolyte reservoir and pump (160) to cool and recycle the electrolyte.

(j) a heater (140) to heat the reactor vessel including the counter-electrode and the working electrode to the desired working temperature.

(k) a hydrogen outlet (109) with a hydrogen relief valve (119). The hydrogen is available for any application requiring hydrogen.

Figure 25:
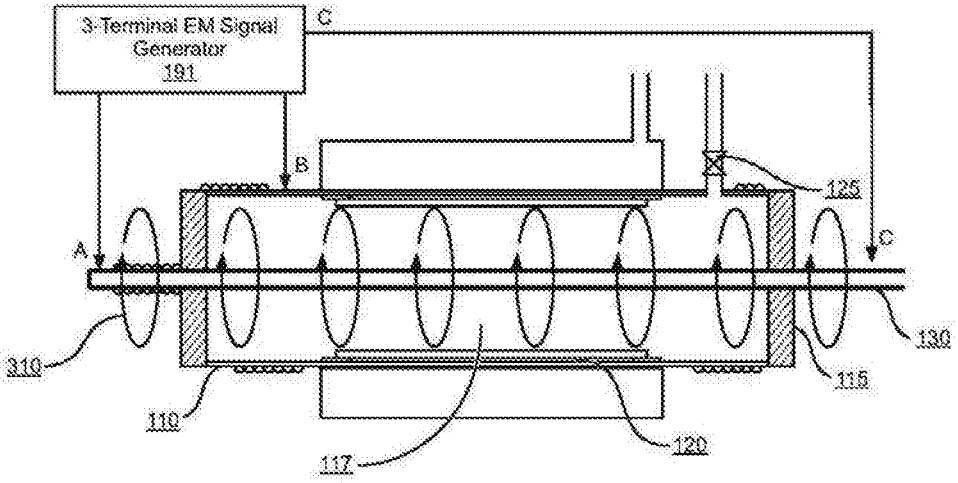
FIG. 25 Electrolysis and circumferential electro-magnetic field(s) detail of FIG. 24.
Figure 26:
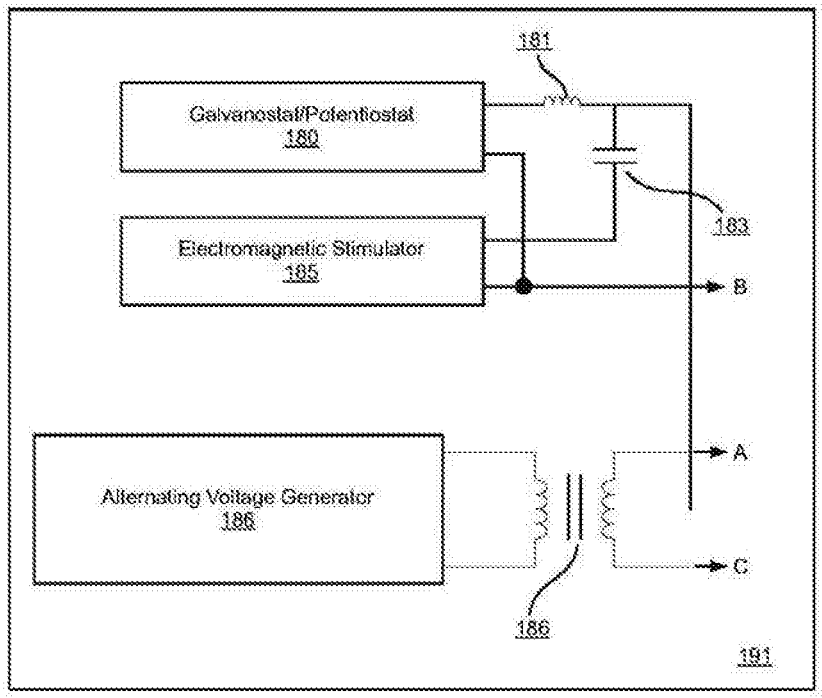

FIG. 25 illustrates detail of the electrical connections of FIG. 24 between the 3-terminal electromagnetic (EM) signal generator (191) shown in detail in FIG. 26. The outputs (A) and (C) connect to the counter electrode (130) and output (B) connects to the electrolysis reactor vessel (110). The counter electrode (130) is insulated from the reactor vessel (110) by electrically insulating feed-throughs, (115). While the field is both inside and outside the reactor vessel, only the field inside the reactor vessel interacts with the electrolysis current.

FIG. 26 illustrates a 3-Terminal electromagnetic (EM) signal generator (191) comprised of a galvanostat/potentiostat (180) and an electromagnetic stimulator (185) which are connected together through a capacitor (183). The electromagnetic stimulator is isolated from the galvanostat/potentiostat by an RF choke (181) and the combined signal is connected to the center tap of the current step-up transformer (187). The electromagnetic stimulator is not required to perform electrolysis.

Figure 27:
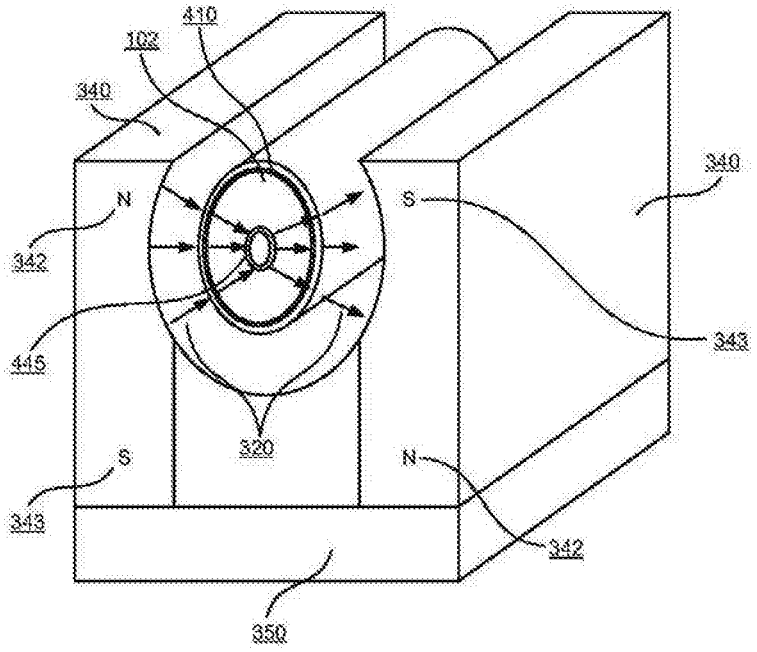
FIG. 27 Electrode design with radial magnetic field.

FIG. 27 illustrates an electrode design with radial magnetic field showing both the ferromagnetic porous or fenestrated conductive pipe counter electrode (445) such as nickel, and a non-magnetic working electrode (410). The arrangement of electrodes is similar to that shown in FIG. 28 where the electrically conducting porous pipe counter electrode (135) is now ferromagnetic (445). The reactor containment vessel and supporting components are not shown in this illustration for clarity. The non-magnetic working electrode is comprised of a hydrogen host material such as nickel or palladium surrounded by a non-magnetic permeable low hydrogen permeable base material such as copper or austenitic stainless steel. The electrodes and their containment vessel are housed in a magnetic field for example a field generated by permanent magnets (340) with the magnetic north poles (342), and south poles (343) configured as shown and where the magnetic field lines from the magnets are closed through a low reluctance ferromagnetic material (350). The magnetic permeable ferromagnetic material of the composite working electrode causes the magnetic lines of flux to be drawn toward the working electrode thereby creating quasi-radial lines of flux (320).

Figure 28:
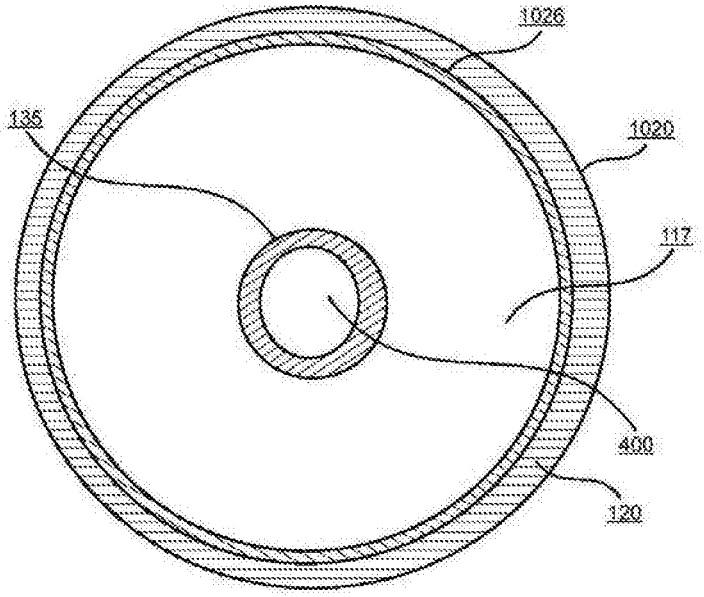
FIG. 28 Electrically conducting porous pipe counter electrode with surrounding working electrode configuration.

FIG. 28 illustrates an electrically conducting porous pipe counter electrode (135) with electrolyte passage (400) that is coaxially located within a working electrode (120) composed of a hydrogen host material (1026) and a low hydrogen permeable, electrically conducting base material (1020). The porous counter electrode (135) serves to both further ionize the electrolyte and uniformly distribute it within the electrolysis chamber (117).

Figure 29:
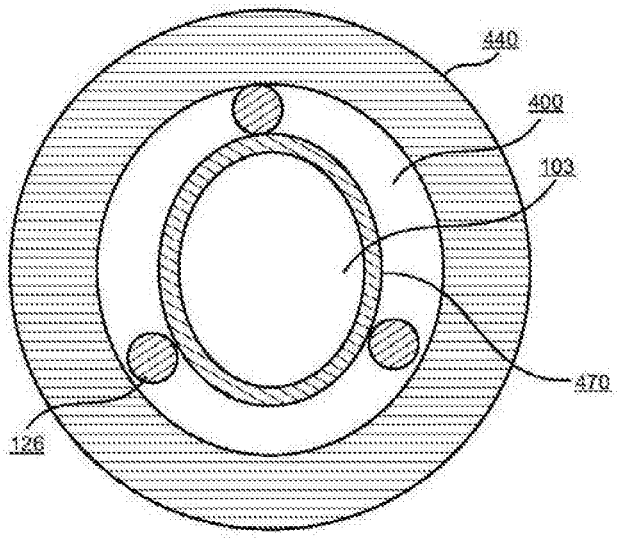
FIG. 29 Composite counter electrode cross-section with a conducting fenestrated pipe surrounded by a porous-ceramic cylinder.

FIG. 29 illustrates a composite counter electrode cross-section with a conducting fenestrated pipe or tube (470) that is surrounded by a porous-ceramic cylinder (440). The combination of the fenestrated pipe and the porous ceramic cylinder assure a uniform distribution of the electrolyte introduced via the electrolyte passage (103).

Figure 30:
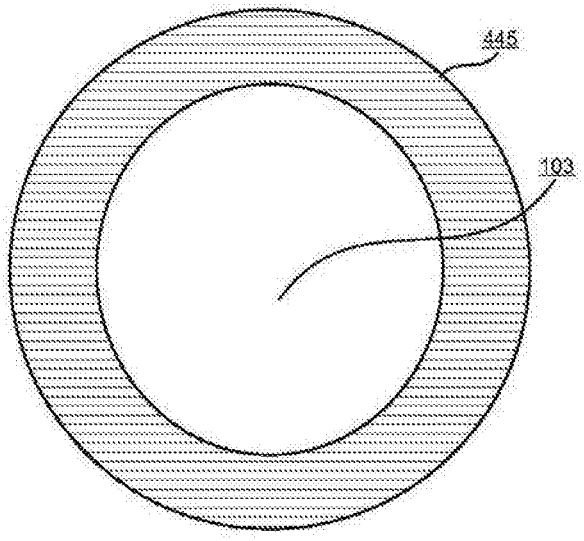
FIG. 30 Conductive porous ferromagnetic counter-electrode cross-section.

FIG. 30 illustrates a conductive porous ferromagnetic counter-electrode cross-section which provides both the electrolyte passage (103) and the ferromagnetic porous or fenestrated conductive pipe (445) which both ionizes and uniformly distributes the ionized electrolyte to the working electrode (not shown.)

Figure 31:
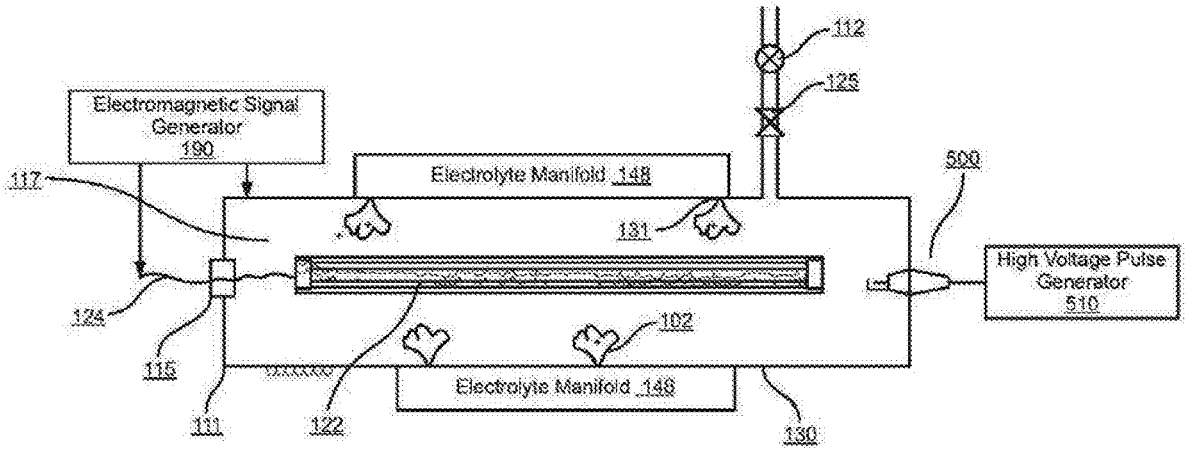
FIG. 31 Eelectrolysis reactor vessel cross-section with spark plug plasma generator and hydrogen/oxygen recombiner.

FIG. 31 illustrates the inclusion of an electrical discharge plasma generator and/or hydrogen oxygen recombiner for example, a spark plug (500) in a typical reactor vessel (111). The electrical discharge plasma generator and/or hydrogen-oxygen recombiner is powered by a high voltage pulse generator (510) such as a solid state ignition system. It should be recognized that the electrical discharge plasma generator can be incorporated into multiple configurations of the reactor vessel subsystem.

Figure 32:
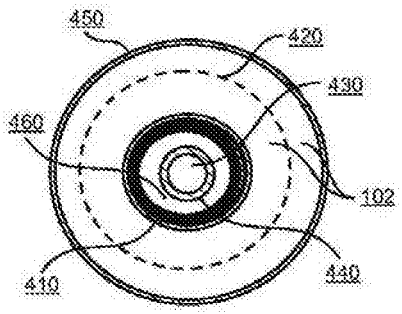
FIG. 32 Coaxial working and counter electrodes in a low-hydrogen-permeable wall vessel cross-section detail.

FIG. 32 illustrates an axial arrangement of a working electrode (410) inside a fenestrated counter electrode (420). The working electrode surrounds a fenestrated cooling fluid passage (430) to introduce cooling fluid and a porous metal or ceramic pipe (440) to uniformly distribute the cooling fluid into the cooling vapor exhaust plenum (460). A low hydrogen permeable containment vessel (450) contains all of the components.

Figure 33:
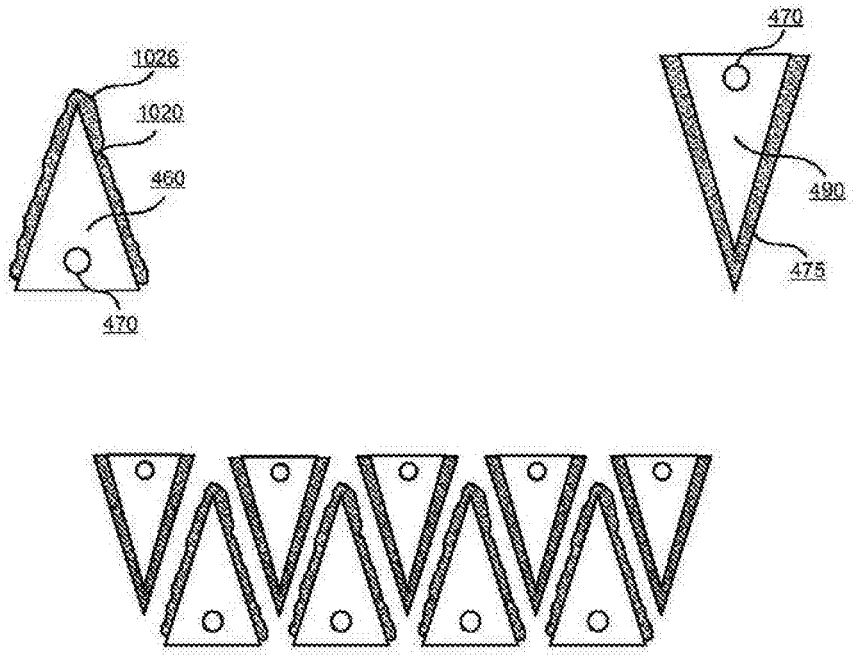
FIG. 33 Alternate arrangement of working and counter electrodes.

FIG. 33 illustrates another alternate arrangement of multiple working and counter electrodes. The alternate composite working electrode includes an electrically conducting low hydrogen permeable base material (1020) on which a hydrogen host material (1026) is deposited. The base material (1020) also forms a cooling vapor exhaust plenum (460) inside which includes a porous or fenestrated pipe to introduce cooling fluid (470). The example alternate counter electrode includes a porous or fenestrated conducting material (475) to uniformly distribute the electrolyte and said alternate counter electrode is shaped to include an electrolyte fluid or vapor plenum (490) and a porous or fenestrated conductive pipe (470) to introduce and ionize the electrolyte. Multiple counter and working electrodes can be configured inside the same reactor vessel, not shown.

The embodiment shown is FIG. 5 is used to illustrate one example of the operation of the electrolysis reactor system as a whole. It begins with preparing and loading the hydrogen containing liquid electrolyte into the electrolyte reservoir and pump (160). Under controls from the Sensor and Control system (30), the reactor vessel (110), working electrode (120) and counter electrode (130) are heated by the heating elements (140) to the desired operating temperature for example 250 degrees C. for the counter-electrodes and the same or higher temperature for the working electrode since the higher temperature increases the diffusivity of the hydrogen. The electromagnetic signal generator (190) applies the desired potential between the counter electrode (130) and the working electrode (120). Under controls from the Sensor and Control subsystem (30), electrolyte is pumped from the electrolyte reservoir and pump (160) through the counter electrode (130) and out through the electrolyte ejector nozzles (131) in the form of an ionized mist or steam (102). Said ionized mist or steam is transported to the working electrode (120) by the electrical potential between the counter electrode (130) and the working electrode (120), monitored and under the control of the Sensor and Control subsystem (30), where the electrolysis occurs and the hydrogen atoms are adsorbed, absorbed and diffuse into the working electrode hydrogen host material, assisted by the electrical potential that produces an equivalent gas pressure, fugacity The Sensor and Control subsystem (30) monitors the temperature of the working electrode and causes the heater to turn on if necessary to maintain the hydrogen host material at a temperature that increases diffusivity. In the event that the loading process becomes exothermic, causing the temperature of the working electrode to increase above the desired temperature, the Sensor and Control subsystem (30) will command the Thermal Management Subsystem (20) to inject cooling fluid in the form of a liquid mist into the heat transfer plenum (142) where the liquid makes fluidic contact with the reactor vessel (110) and extracts heat as it warms and absorbs the heat of vaporization as it changes phase from a liquid to steam with the steam being transported through a control valve (143) to the Thermal Management Subsystem (20) for energy recovery using one of several techniques that are well known for example a steam turbine, thermo-electric generator or organic Rankin engine. Alternatively, the Sensor and Control subsystem (30) can command the galvanostat/potentiostat to reduce the current or electric potential between the counter electrode and the working electrode to reduce hydrogen flow and thus the amount of heat being produced in the working electrode.

It should be recognized that in addition to temperature, external stimuli including static and dynamic electromagnetic fields, plasma generators, sonic and ultrasonic vibration, and pressure including electrolysis potential cycling and overpotential (fugacity), can improve the transfer of hydrogen into and out of the working electrode and can be incorporated as shown in the figures.

After the working electrode has been loaded to capacity with hydrogen, the working electrode, reactor vessel, and counter electrode are cooled to reduce diffusivity of the hydrogen out of the host lattice material for storage of the hydrogen. The electrical potential can be maintained between the counter electrode and the working electrode to produce a galvanostatic pressure to maintain storage. When the stored hydrogen is required by a fuel cell or other application, the potential between the counter electrode and the working electrode is reduced and may even be reversed to drive the hydrogen out of the working electrode, and out through the hydrogen outlet (109) for use.

It should be recognized that the Electrolysis Reactor System (1) involves numerous nonlinear interactions. System operation is managed by the Sensor and Control subsystem (30) which receives numerous inputs from multiple sensors located as required throughout the Electrolysis Reactor System (1) and using computer algorithms including nonlinear, sometimes referred to as control of chaos, algorithms, provides output signals to the numerous control points of the system and external stimuli of the working electrode and electrolyte.

In an alternative embodiment as shown in FIG. 6, the electrolyte is a hydrogen containing gas (107), for example but not limited to $H_2$ or $H_2$ in methane or a hydrogen containing compound that will decompose to hydrogen when heated such as but not limited to $LiAlH_4$ or LiH and that the hydrogen gas can be then ionized. For this embodiment, the oxygen separator/recombiner (125) and the vapor electrolyte condenser (150) are not required and replaced by a gas electrolyte reservoir and pump (161) and a gas ionizer (147) which are under the control of the Sensor and Control subsystem (30). The remaining functions of this embodiment are functionally the same as previously described above.

FIGS. 7, 8*a* and 8*b* illustrate examples of alternative configurations wherein the positioning of the working electrode and the counter electrode are repositioned while providing the required functions of the working electrode and counter electrode. The remaining functions of these embodiments are functionally the same as previously described.

FIGS. 9 through 15 illustrate examples of alternative configurations of the working electrode which can be incorporated in the embodiments described above. The working electrode can simultaneously incorporate different hydrogen host materials to include any lattice materials into which hydrogen will diffuse including but are not limited to palladium, palladium alloys, nickel, nickel alloys, ceramics, and other materials or aggregates of materials for example nanoparticles of nickel and zirconium oxide as well as nanoparticles of palladium and zirconium oxide.

FIGS. 19, 23, 24, 25, and 27 illustrate examples of embodiments involving the application of axial (300), transverse (330), radial (320), and circumferential (310) static and dynamic magnetic fields to assist in the diffusion of hydrogen into and/or out of the working electrode. The addition of magnetic fields shown in these embodiments work with the electrolysis current to load and release the hydrogen into and out of the host lattice of the working electrode as described in previous embodiments.

FIG. 31 illustrates an embodiment that includes the addition of a spark generator (500) and a high voltage pulse generator (510) to provide both ionized hydrogen gas and/or to recombine excess hydrogen and oxygen. This feature can be incorporated in the embodiments described above.

We claim:

1. A gas or vapor electrolysis reactor system, comprising:

an electrolyte containing at least one of a gas or a vapor, each of which including hydrogen or isotopes of hydrogen and ions thereof;

a reactor vessel having a heater to heat said reactor vessel and a chamber within which to contain said electrolyte, said reactor vessel including an electrolyte inlet and an electrolyte outlet that enable the electrolyte to flow into and flow out of the chamber of said reactor vessel;

at least one counter-electrode and at least one working electrode located within the chamber of said reactor vessel and electrically isolated from one another, said at least one counter and working electrodes lying in fluidic communication with said electrolyte, said at least one working electrode being comprised of a hydrogen host material to store hydrogen;

a source of electrical potential or electrical current communicating with said at least one counter-electrode and said at least one working electrode to thereby create an electric field to establish electrolysis between said electrodes whereby the hydrogen ions are transported from said electrolyte to said working electrode to be stored by and produce heat in said working electrode;

a sensor and control subsystem including at least one temperature sensor to monitor the temperature of said gas or vapor electrolysis reactor system and provide output signals to control said reactor system depending upon the temperature thereof; and a thermal management subsystem communicating with said sensor and control subsystem and responsive to the output signals provided thereby to control the temperature of said at least one working electrode, said thermal management subsystem including a heater driver to cause the heater of said reactor vessel to heat said working electrode to increase the hydrogen diffusivity of the hydrogen host material and a source of cooling fluid to cool said working electrode to reduce the hydrogen diffusivity of the hydrogen host material.

2. The gas or vapor electrolysis reactor system recited in claim 1, wherein said electrolyte is supplied to said counter-electrode located within the chamber of said reactor vessel by way of an electrically insulated feed-through of said reactor vessel.

3. The gas or vapor electrolysis reactor system recited in claim 1, wherein said thermal management subsystem also includes a heat transfer plenum surrounding said reactor vessel and lying in thermal contact with said at least one working electrode located within said chamber thereof and at least one cooling fluid injector to inject cooling fluid from said source thereof into said heat transfer plenum to cool said working electrode.

4. The gas or vapor electrolysis reactor system recited in claim 3, wherein the heater of said thermal management subsystem is configured to heat said reactor vessel and said at least one working electrode located within the chamber thereof.

5. The gas or vapor electrolysis reactor system recited in claim 1, wherein said electrolyte outlet is an electrolyte relief valve communicating with said electrolyte contained within the chamber of said reactor vessel to control the pressure of said electrolyte.

6. The gas or vapor electrolysis reactor system recited in claim 1, wherein said thermal management subsystem also includes energy recovery means lying in thermal contact with the electrolyte that flows out of said reactor vessel via said electrolyte outlet, said energy recovery means reclaiming the heat from said outflowing electrolyte that is produced when the electrolysis is established between said at least one counter and working electrodes.

7. The gas or vapor electrolysis reactor system recited in claim 1, wherein the at least one working electrode includes a low hydrogen permeable diffusion barrier to maintain the storage of the hydrogen in the hydrogen host material of said working electrode.

8. A gas or vapor electrolysis reactor system, comprising:

an electrolyte containing at least one of a gas or a vapor, each of which including hydrogen or isotopes of hydrogen and the ions thereof;

a reactor vessel having a heater to heat said reactor vessel and a chamber within which to contain said electrolyte, said reactor vessel including an electrolyte inlet and an electrolyte outlet that enable the electrolyte to flow into and flow out of the chamber of said reactor vessel;

at least one counter-electrode and at least one working electrode located within the chamber of said reactor vessel and electrically isolated from one another, said at least one counter and working electrodes lying in fluidic communication with the electrolyte, said at teas one working electrode being comprised of a hydrogen host material to store hydrogen therewithin and release the stored hydrogen therefrom;

a source of electrical potential or electrical current communicating with said at least one counter-electrode and said at least one working electrode to create an, electric field to establish electrolysis between said electrodes, said source of electrical potential or electrical current being adjustable to correspondingly adjust the electric field and thereby provide a controlled release of the hydrogen stored within the hydrogen host material of said working electrode;

a sensor and control subsystem including at least one temperature sensor to monitor the temperature of said working electrode said temperature and control subsystem providing output signals to control the temperature of said working electrode; and a thermal management subsystem communicating with said sensor and control subsystem and responsive to the output signals provided thereby and including a heater driver to cause the heater of said reactor vessel to heat said working electrode to increase the hydrogen diffusivity of the hydrogen host material, the output signals provided by said sensor and control subsystem also adjusting the electric field created by said source of electrical potential or electrical current to provide a controlled release of the hydrogen stored by said hydrogen host material.

9. The gas or vapor electrolysis reactor system recited in claim 8, wherein the polarity of the source of electrical potential or electrical current is reversible to adjust the electric field and thereby cause the controlled release of the hydrogen stored within the hydrogen host material of said working electrode.

10. The gas or vapor electrolysis reactor system recited in claim 8, wherein said electrolyte outlet is an electrolyte relief valve communicating with said reactor vessel to control the pressure of said electrolyte within the chamber of said reactor vessel.

11. The gas or vapor electrolysis reactor system recited in claim 8, wherein said thermal management subsystem also includes energy recovery means lying in thermal contact with the electrolyte that flows out of said reactor vessel via said electrolyte outlet, said energy recovery means reclaiming the heat from said outflowing electrolyte that is generated due to the electrolysis between said at least one counter and working electrodes.

12. A gas or vapor electrolysis reactor system, comprising:

an electrolyte containing at least one of a gas or a vapor, each of which including hydrogen or isotopes of hydrogen and ions thereof;

a reactor vessel having a heater to heat said reactor vessel and a chamber within which to contain said electrolyte, said reactor vessel including an electrolyte inlet and an electrolyte outlet that enable the electrolyte to flow into and flow out of the reactor vessel;

at least one counter-electrode and at least one working electrode located within the chamber of said reactor vessel and electrically isolated from one another, said at least one counter and working electrodes lying in fluidic communication with said electrolyte, said at least one working electrode being comprised of a hydrogen host material to store hydrogen;

a source of electrical potential or electrical current communicating with said at least one counter-electrode and said at least one working electrode to thereby create an electric field to establish electrolysis between said electrodes whereby the hydrogen ions are transported from said electrolyte to said at least one working electrode to be stored in the hydrogen host material of said at least one working electrode to heat said working electrode;

a source of magnetic field to permeate the at least one working electrode in order to interact with the atoms in both the hydrogen host material from which the at least one working electrode is comprised and the hydrogen that is stored in said hydrogen host material;

a sensor and control subsystem including at least one temperature sensor to monitor the temperature of said gas or vapor electrolysis reactor system and provide output signals to co said reactor system depending upon the temperature thereof; and a thermal management subsystem communicating with said sensor and control subsystem and responsive to the output signals provided thereby to control the temperature of said at least one working electrode, said thermal management subsystem including a heater driver to cause the heater of said reactor vessel to heat said working electrode to increase the hydrogen diffusivity of the hydrogen host material and a source of cooling fluid to cool said working electrode to reduce the hydrogen diffusivity of the hydrogen host material.

13. The gas or vapor electrolysis reactor system recited in claim 1, wherein the source of electrical potential or electrical current galvanically or galvanistically compresses the hydrogen ions into the hydrogen host material of said at least one working electrode.

* * * * *